US009744643B2

(12) United States Patent
Miller

(10) Patent No.: US 9,744,643 B2
(45) Date of Patent: Aug. 29, 2017

(54) APPARATUS FOR UNDERWATER ABRASIVE ENTRAINMENT WATERJET CUTTING

(71) Applicant: Paul L Miller, Harvest, AL (US)

(72) Inventor: Paul L Miller, Harvest, AL (US)

(73) Assignee: G.D.O. Inc, Elk River, MN (US)

( * ) Notice: Subject to any disclaimer, the term of this patent is extended or adjusted under 35 U.S.C. 154(b) by 0 days.

(21) Appl. No.: 15/239,589

(22) Filed: Aug. 17, 2016

(65) Prior Publication Data

US 2017/0157743 A1 Jun. 8, 2017

Related U.S. Application Data

(62) Division of application No. 14/036,639, filed on Sep. 25, 2013, now Pat. No. 9,446,500.

(51) Int. Cl.

| | |
|---|---|
| ***B24C 1/04*** | (2006.01) |
| ***B24C 3/00*** | (2006.01) |
| ***B24C 7/00*** | (2006.01) |
| ***B24C 3/12*** | (2006.01) |

(52) U.S. Cl.

CPC ..... *B24C 1/045* (2013.01); *B24C 3/00* (2013.01); *B24C 3/12* (2013.01); *B24C 7/0023* (2013.01)

(58) Field of Classification Search

CPC ..... B24C 1/045; B24C 3/12; B24C 7/0015; B24C 7/0023; B24C 11/00; B24C 11/005

See application file for complete search history.

(56) References Cited

U.S. PATENT DOCUMENTS

| | | | | | |
|---|---|---|---|---|---|
| 2,985,050 | A * | 5/1961 | Schwacha | B26F 3/004 | 125/23.01 |
| 3,323,257 | A * | 6/1967 | Fonti | B24C 7/0007 | 451/101 |
| 4,555,872 | A * | 12/1985 | Yie | B05B 7/1431 | 451/102 |
| 5,065,551 | A * | 11/1991 | Fraser | B05B 7/1431 | 451/40 |
| 5,241,986 | A * | 9/1993 | Yie | B05B 1/306 | 137/512 |
| 5,363,603 | A * | 11/1994 | Miller | B24C 11/00 | 451/39 |
| 5,441,441 | A * | 8/1995 | Cook | B08B 3/02 | 451/36 |
| 5,524,545 | A * | 6/1996 | Miller | A62D 3/176 | 102/293 |
| 5,735,729 | A * | 4/1998 | Kobayashi | C09K 3/1463 | 451/36 |
| 5,785,581 | A * | 7/1998 | Settles | B24C 1/003 | 451/39 |
| 6,077,152 | A * | 6/2000 | Warehime | B24C 1/045 | 451/75 |
| 6,240,595 | B1 * | 6/2001 | Dupuy | B05B 15/0425 | 15/302 |

(Continued)

*Primary Examiner* — Timothy V Eley

(74) *Attorney, Agent, or Firm* — Henry E. Naylor

(57) ABSTRACT

The use of abrasive entrainment waterjet technology to cut objects located at the bottom of a body of water. Abrasive is conducted to an abrasive waterjet cutting head under the control of an abrasive feed and metering system that monitors the differential pressure between the cutting head and reservoir of abrasive material and maintains the pressure at the abrasive reservoir greater than the pressure hydrostatic pressure at the cutting head.

5 Claims, 24 Drawing Sheets

(56) References Cited

U.S. PATENT DOCUMENTS

| | | | | |
|---|---|---|---|---|
| 6,254,462 | B1 * | 7/2001 | Kelton | B24C 9/006 451/350 |
| 6,283,833 | B1 * | 9/2001 | Pao | B24C 5/04 451/102 |
| 6,656,014 | B2 * | 12/2003 | Aulson | B24C 1/045 451/2 |
| 6,886,444 | B2 * | 5/2005 | Reid | B24C 1/045 29/426.4 |
| 7,186,167 | B2 * | 3/2007 | Joslin | B24C 1/045 451/102 |
| 7,225,716 | B1 * | 6/2007 | Miller | F42B 33/062 86/50 |
| 7,300,336 | B1 * | 11/2007 | Nguyen | B24C 7/0053 451/101 |
| 8,123,591 | B2 * | 2/2012 | Olsen | B24B 57/02 451/2 |
| 8,371,903 | B2 * | 2/2013 | Goetsch | B24C 1/045 269/105 |
| 9,003,936 | B2 * | 4/2015 | Chillman | B24C 1/045 83/168 |
| 2007/0111642 | A1 * | 5/2007 | Davis | B24C 3/325 451/38 |
| 2010/0136888 | A1 * | 6/2010 | Bettazza | B24C 11/00 451/38 |
| 2011/0104991 | A1 * | 5/2011 | O'Donoghue | B24C 1/10 451/36 |
| 2012/0021676 | A1 * | 1/2012 | Schubert | B24C 1/045 451/38 |
| 2012/0252326 | A1 * | 10/2012 | Schubert | B24C 1/045 451/60 |
| 2012/0273277 | A1 * | 11/2012 | Blang | B24C 1/045 175/67 |
| 2014/0202684 | A1 * | 7/2014 | Danait | E21B 43/16 166/246 |

* cited by examiner

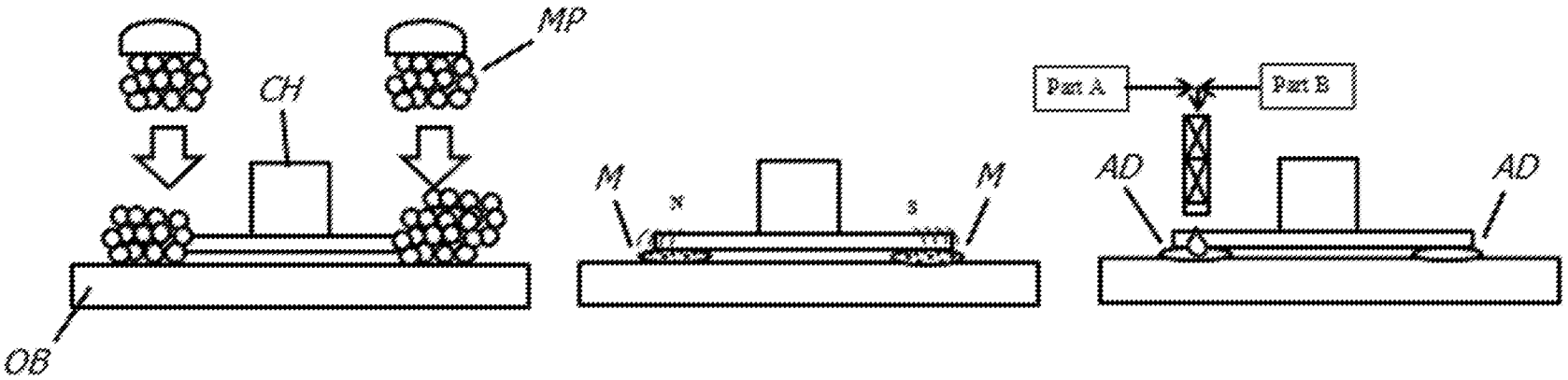
Fig. 8A
Fig. 8B
Fig. 8C
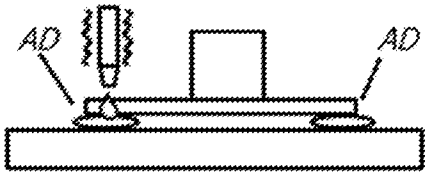
Fig. 8D

APPARATUS FOR UNDERWATER ABRASIVE ENTRAINMENT WATERJET CUTTING

CROSS-REFERENCE TO RELATED APPLICATIONS

This application is a Division based on U.S. Ser. No. 14/036,639 which is the Non-Provisional of Provisional Patent Applications 61/705,420 filed Sep. 25, 2012 and 61/826,078 filed May 22, 2013.

FIELD OF THE INVENTION

This invention relates to the use of abrasive entrainment waterjet technology to cut objects located at the bottom of a body of water. Abrasive is conducted to an abrasive waterjet cutting head under the control of an abrasive feed and metering system that monitors the differential pressure between the cutting head and reservoir of abrasive material and maintains the pressure at the abrasive reservoir greater than the pressure hydrostatic pressure at the cutting head.

BACKGROUND OF THE INVENTION

There is a demand for underwater cutting of metals, stone, and other materials for such things as mining, salvage, rescue work, infrastructure development, petroleum exploration and development, and environmental remediation. Underwater work environments are among the most difficult operating areas for cutting materials. Problems with hydrostatic pressure, high liquid viscosity (compared to air), water's high thermal and electrical conductivity, and the lack of visibility all hamper conventional cutting technologies. Non-limiting applications for safe underwater cutting systems include cutting underwater on shipwrecks and pipeline; clearing passageways through rocks for underwater communications and electrical power infrastructure; disposal of discarded military munitions (DMM), etc. Oxy-arc, oxy-fuel, oxy-hydrogen and underwater arc cutting can be used to cut steels underwater at limited depths. Mechanical drills and cutting tools, such as circular, ring, band, wire, and abrasive saws can also by used underwater with varying degrees of success. None of these methods are easy to perform underwater and all have limitations that restrict their use. They are also generally hazardous to use around explosive materials, which are all too frequently found underwater.

One conventional method of disposing of underwater munitions is to detonate them in-situ using highly skilled divers to place the necessary explosive charges. Unfortunately, fish and marine mammals such as whales, dolphins, and porpoises can be killed or seriously injured up to several kilometers from an underwater detonation due to the effects of explosive shock overpressure. Abrasive entrainment waterjets have the potential of providing a safe and environmentally friendly alternative to conventional underwater cutting technologies if certain obstacles can be overcome. Such obstacles include being able to feed a substantially steady flow of abrasive to the cutting head, can be overcome.

The word "waterjet" is an ambiguous term used to broadly describe essentially any process that expels a liquid, regardless of pressure or fluid chemistry, through an orifice to form a fluid jet. The wide-ranging term of "waterjet" is used to include everything from low-pressure dental hygiene equipment to high-pressure systems incorporating abrasives that can cut through thick hardened steel and rock. In addition, a further confusion is introduced as the use of the word "water" in the term "waterjet" does not limit the application's use to only pure water ($H_2O$) as the fluid in the waterjet. In this context the word "water" can imply any fluid, any solution, and any solid material that will flow through an orifice under pressure or any gas that liquefies under pressure, such as ammonia, to form what should more precisely be termed a "fluid" jet, but by convention is defined in the trade as a "waterjet."

Waterjets are fast, flexible, reasonably precise, and are relatively easy to use. They use the technology of high-pressure water being forced through a small hole, typically called the "orifice" or "jewel" which is typically about 0.007" to 0.020" in diameter (0.18 to 0.4 mm), to concentrate an extreme amount of energy in a small area. The restriction of the tiny orifice creates high pressure and a high-velocity jet. The inlet (process) water for a pure waterjet is typically pressurized between 20,000 psi (138 MPa) and 60,000 psi (414 MPa). This is forced through a tiny hole in the jewel,). This creates a very high-velocity, very thin jet of water traveling as close to the speed of sound.

Abrasive slurry waterjet, also known as an abrasive suspension jet, typically uses a hopper filled with abrasive, water, and a slurrying or suspension agent. This combined mixture is then pressurized and forced through the orifice of the waterjet cutting head. The abrasive slurry system must keep the abrasive in constant suspension, by chemical additives or mechanical means, in order to prevent the abrasive from dropping out of suspension in the piping which leads to plugging and disabling of the system. Likewise, the flow of pressurized abrasive and water slurry mix is highly erosive to piping, valves, and fittings used in the system. In addition, one or more large pressure vessels must typically be used to contain a sufficient amount of abrasive slurry for cutting. Consequently, an abrasive slurry system is typically limited in pressure to approximately 140 MPa and normally operates at pressures closer to 70 MPa.

An abrasive entrainment waterjet uses a high velocity fluid jet, formed by pressurized water passing through an orifice (jewel) of the cutting head resulting in a partial vacuum in a mixing chamber downstream of the orifice that aspirates and entrains abrasive particles that are introduced into said mixing chamber and into the fluid jet. Abrasive entrainment waterjet technology has several advantages over abrasive slurry waterjet technology. For example, it is more reliable; it requires less maintenance; it is being able to operate at internal system pressures up to 1,000 MPa or more; it can operate in a continuous mode rather than in a batch mode; it doesn't require expensive chemical additives; and it is able to operate with significantly lower abrasive consumption.

Waterjet technology has been used underwater for cutting metals and stone. For example, waterjets were taught as being effective in underwater mining operations. See Borkowski, P. and Borkowski, J. (2011). "Basis of High-pressure Water Jet Implementation for Poly-metallic Concretions Output from the Ocean's Bottom," *Rocznik Ochrony Środowiska* Selected full texts, 13, ppg. 65-82. An abrasive slurry system is taught as being capable of operating underwater as long as the internal fluid pressure is substantially higher than the surrounding hydrostatic pressure.

While the art teaches the possibility of using waterjet technology for underwater cutting, serious problems still exist and must be overcome before such technology can be used commercially, especially in deep water.

SUMMARY OF THE INVENTION

In accordance with the present invention there if provided A method for cutting objects located under a body of water using entrainment abrasive waterjet technology, which method comprises:

a) positioning an entrainment abrasive waterjet system in the proximity of an underwater object to be cut, which abrasive waterjet system is comprised of a waterjet pump, an entrainment abrasive waterjet cutting head in fluid communication with said waterjet pump and in fluid communication with a source of abrasive material;
b) supplying a flow of process water to be pressurized to said waterjet pump which increases the pressure of the flow of water to a pressure of at least about 280 MPa;
c) supplying a flow of abrasive material to said waterjet cutting head; and
d) controlling the waterjet cutting head delivering a high velocity jet of water and abrasive to achieve the desired cutting track and rate of cutting of said underwater object using a control system.

BRIEF DESCRIPTION OF THE FIGURES

FIGS. 8A to 8I are simplified illustrations of preferred embodiments for attaching a moveable waterjet cutting head to the targeted object to be cut.

DETAILED DESCRIPTION OF THE INVENTION

Figure 1A:
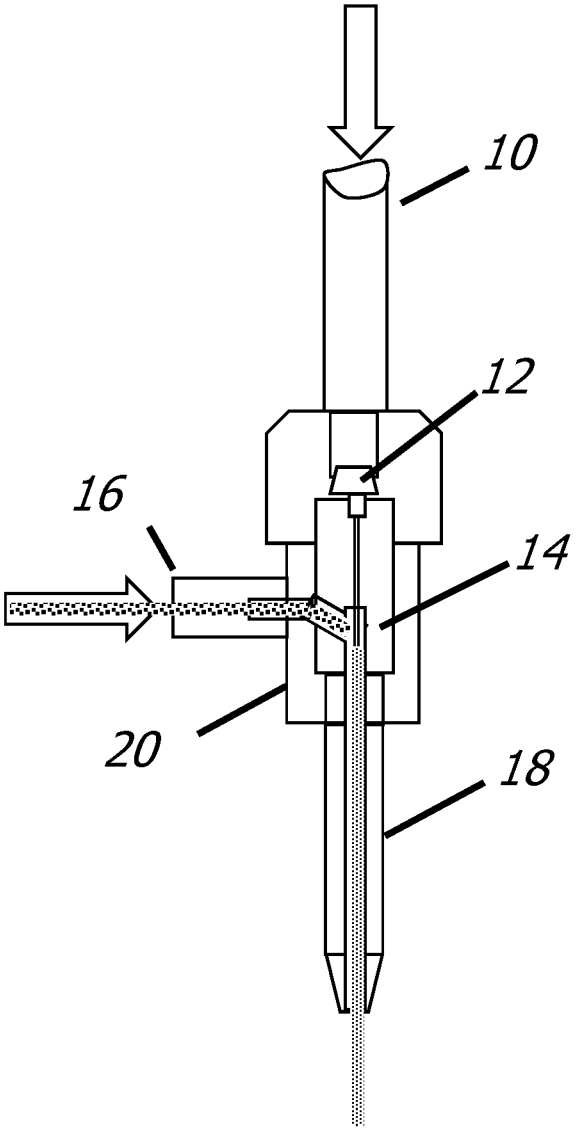
FIG. 1A hereof is a simplified representation of an entrainment abrasive waterjet cutting head and FIG. 1B is a block diagram of a method for feeding water and an abrasive to the waterjet cutting head.
Figure 1B:
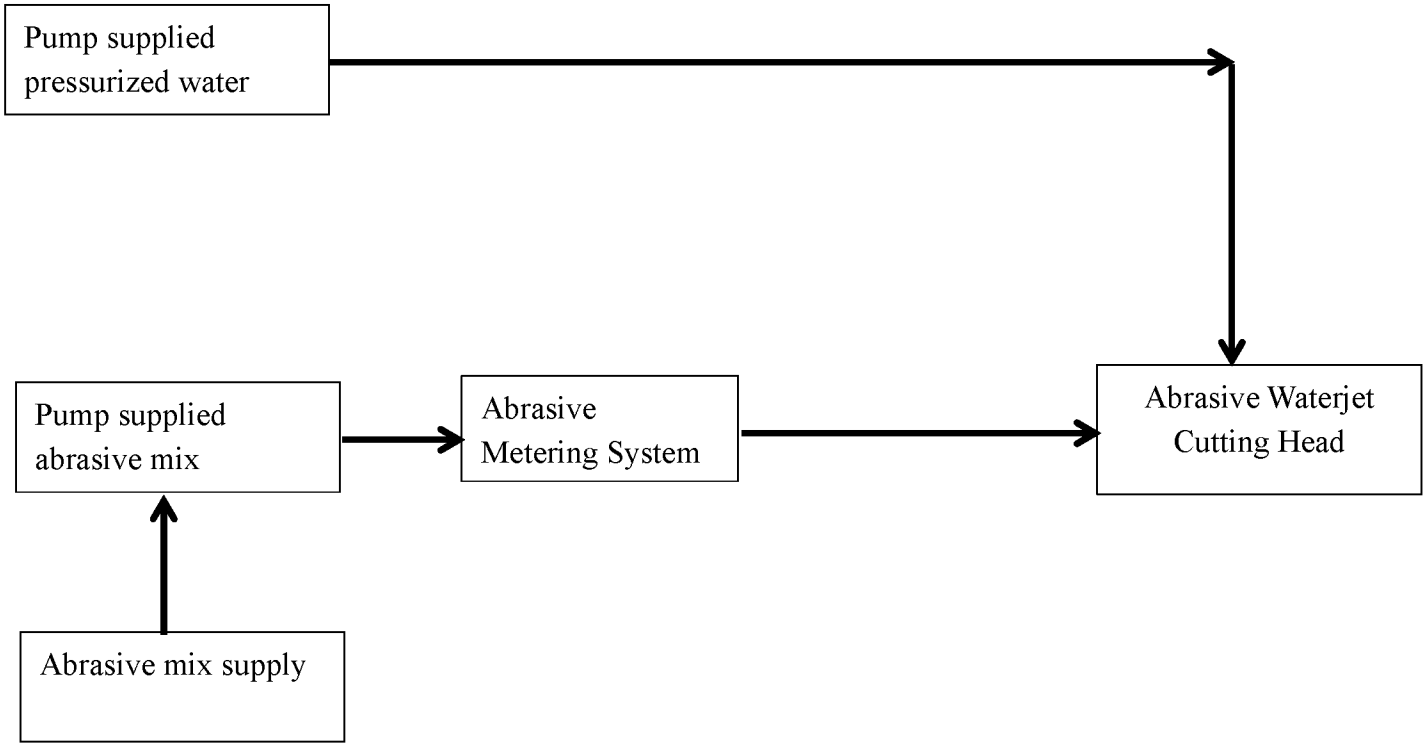

By underwater, or under a body of water, we mean that the object to be cut is found resting or part of a structure secured to the bottom of a body of water. Non-limiting examples of bodies of water include oceans, seas, bays, rivers, as well as man-made bodies of water such as reservoirs and lakes. For purposes of the present invention the object to be cut will typically be at depths from about 30 ft (10 meters) to about 20,000 ft (6100 meters), preferably from about 300 ft (91 meters to 1500 meters) 300 ft to about 5,000 ft.

An abrasive entrainment waterjet has a distinct disadvantage as compared to abrasive slurry waterjet when used underwater because the abrasive transport and feed system can be hampered, if not completely disrupted, by the hydrostatic backpressure of surrounding water forcing its way into the abrasive system. Water entering the abrasive feed system will wet the abrasive resulting in a wet abrasive mix that will become coarse and mud-like. Such a mix can result in plugging the system, similar to what happens to an abrasive slurry jet when the aqueous suspension fails. Hydrostatic backpressure increases underwater at the rate of about 9.8 kPa/m (0.432 psi/ft.) of depth in freshwater and at roughly the rate of 10 kPa/m (0.445 psi/ft.) of depth in seawater. Consequently, the problem is rapidly exacerbated as depth increases. In addition, the cold temperature of the surrounding seawater can cause moisture to be precipitated in the abrasive feed system.

In order to utilize the distinct advantages of abrasive entrainment waterjet technology over abrasive slurry waterjet technology and to be able to commercially operate underwater the following problems need to be addressed:

I. Supplying water at a pressure of at least about 280 MPa to the waterjet cutting head.

II. Supplying a measured and substantially continuous stream of abrasive to the abrasive waterjet cutting head.

III. Preventing plugging or jamming of the abrasive waterjet cutting head.

In addition, and in most instances, the abrasive waterjet cutting also will also require the following:

IV. Attaching the abrasive waterjet cutting head to the targeted object.

V. Controlling the cutting of the abrasive waterjet cutting head on the targeted object.

For certain applications, such as underwater accessing and disposal of hazardous materials or discarded military munitions, the following additional step may be needed or required:

VI. Waterjet wash-out of the contents of the targeted object accessed by the abrasive waterjet cutting head, and collecting the contents of the targeted object washed-out.

Part 1—Supplying High Pressure Water Underwater

The use of surface supplied high pressure fresh water is generally adequate for shallow water operations of an abrasive entrainment waterjet. However, using a high-pressure hose to supply water from the surface to an abrasive entrainment waterjet cutting head underwater is a problem that increases with increasing depth. For example, high pressure hoses are expensive, heavy, and have a pressure drop due to internal fluid friction. It is known in the art that submerged cable lengths of at least 2.5 times the water depth are required for efficient operations. The weight of a typical high pressure hose capable of handling >280 MPa pressure, preferably greater than about 300 MPa is about 1.23 lb/ft. Consequently, operations at depths of 400 m (1300 ft.) would require about 1,000 m (3,300 ft.) of hose with over 1.8 tons (4,000 lb.) of line tension pulling on the hose just from its own weight.

In a preferred embodiment of the present invention, the waterjet pump is an intensifier pump and it is powered by hydraulic power fed by hydraulic hoses from pumps on the surface, typically operating at pressures from about 14 MPa to 105 MPa, preferably from about 14 MPa to 35 MPa, to the waterjet pump located underwater. The pressurized hydraulic oil is conducted to the waterjet pump and the resulting depressurized oil is returned to the pump's oil reservoir at the surface. The hydraulic feed hose and return hose are significantly lighter and less expensive than high-pressure waterjet hoses. The exhaust pressure alone is sufficient to pump the spent hydraulic oil up the return line and back to the surface. As an alternative a supplementary pump can be added to assist in pumping the oil back for reuse. Any type of waterjet pump can be used in the practice of the present invention as long as it is capable of delivering a jet of water, with entrained abrasive, at a pressure of at least about 280 MPa to about 1000 MPa. Preferred types of waterjet pumps for use in the present invention are intensifier pumps and reciprocating pumps. Waterjet intensifier pumps are well known in the art and utilize the so-called "intensification' principle. A waterjet intensifier pump typically operates by having pressurized hydraulic oil flow into one side of a centrally located hydraulic piston having double ended piston rods extending into the high pressure water cylinders at each end. The central hydraulic piston of the intensifier pump is typically 20 times the area of each piston rod giving a 20:1 intensification ratio. The piston rods, in turn, form the high pressure water pistons. Consequently, an application of 14 MPa hydraulic oil to the central hydraulic piston results in a twenty-fold intensification of pressure in the water cylinder and yields an outlet water pressure of 280 MPa. The outlet pressure of the water can be controlled by adjusting the inlet hydraulic oil pressure. When the centrally located hydraulic piston reaches the end of its stroke, a hydraulic valve body switches the flow of oil to the opposite side of the hydraulic piston and the process continues with the opposite water piston. The depressurized oil from the central cylinder is exhausted via the control valves to an exhaust port connected with an oil return to the surface.

A reciprocating waterjet pump can also be used, preferably a conventional crankshaft piston waterjet pump, such as a Hammelmann HDP 70 piston pump. If a reciprocating pump is used it cannot be directly driven by hydraulic, but must be driven by a prime mover. A prime mover is herein defined as a motor or device that transforms energy from/to thermal, electrical, or pressure to mechanical rotary force. A preferred prime mover for practice of the present invention is a hydraulic motor or a specialized waterproof electric motor using either on-board hydraulic fluid from the ROV or on-board electrical power to drive the reciprocating waterjet pump.

It will be understood that a waterjet intensifier pump is only driven by a hydraulic fluid from a hydraulic pump either at the surface or located subsea. The hydraulic fluid can be any suitable preferably a hydraulic oil or water, particularly seawater. The hydraulic pump can be thought of as a prime mover for the waterjet intensifier pump. A waterjet reciprocating pump is driven by a prime mover other than a hydraulic pump.

Water, either fresh or seawater, can be pumped as the hydraulic fluid, pressurized to pressures of about 14 MPa to about 105 MPa to power a submerged waterjet intensifier pump. It can then be discharged underwater. The use of pressurized water has the advantages of not requiring the use of expensive hydraulic oil. It also eliminates the requirement of an oil return line, and minimizes the likelihood of an environmental discharge of hydraulic oil. Pressurized seawater from a surface mounted pump can be conducted to the submerged waterjet pump by using a conventional hydraulic hose, as opposed to high pressure waterjet hose. The pressurized hydraulic oil or water from the surface can power either a prime mover, such as a conventional hydraulic motor powering a reciprocating waterjet pump or used to directly drive a high pressure waterjet intensifier.

In order to provide high pressure water with reduced wear and increased reliability of equipment, it is preferred to demineralize the process water that is used at high pressures. By process water we mean the water that is pressurized by the waterjet pump and used for cutting. It is preferred that the process water contain no more than about 350 parts per million total dissolved solids. In comparison, seawater is typically in the range of about 35 parts per thousand of dissolved solids. Process water from a surface ship can be supplied along in an umbilical cord bundle along with power and control cabling. As a second method, clean process water can be stored on a remotely operated vehicle (ROV) or in a separate storage container, either rigid or collapsible. The container can be mounted in a detachable larger container, or with one or more attachment points that will allow free movement of the ROV to allow quick release for replenishment or in case of an emergency with the ROV. An ROV is an underwater robot that is usually controlled from the surface by an operator. Typical ROVs are equipped with hydraulic manipulators, a vision system, and a remote control system to allow the operator to maneuver the ROV to a desired location under water to perform its intended task.

A third method is to filter seawater. A preferred aspect of this method is the use of a submerged reverse osmosis (RO) membrane unit, preferably in combination with one or more prefilters, preferably a 10-30 micron prefilter(s) to desalinate seawater. This will substantially improve the quality of the process water without requiring that clean process water be conducted from the surface to excessive depths. RO systems remove such things as salts, microorganisms and many high molecular weight organics. The RO process water can be used as produced or it can be stored in a separate storage container, either rigid or collapsible. RO is a membrane separation process in which feed water flows along the membrane surface under pressure. Purified water permeates the membrane and is collected, while the concentrated water, containing dissolved salts and un-dissolved material that does not flow through the membrane, is discharged. The reverse osmosis membrane of the reverse osmosis unit(s) can be any of those known in the art. Reverse osmosis membranes can be divided into two categories: (1) asymmetric membranes prepared from a single polymeric material and (2) thin-film composite membranes prepared from a first and a second polymeric material. Asymmetric membranes typically have a dense polymeric discriminating layer supported on a porous support formed from the same polymeric material. The dense skin layer determines the flux and selectivity of the membrane while the porous sub-layer serves only as a mechanical support for the skin layer. Non-limiting examples include asymmetric cellulose acetate membranes. Thin-film composite membranes comprise a permselective discriminating layer formed from a first polymeric material anchored onto a porous support material formed from a second polymeric material. Generally the permselective discriminating layer is comprised of a cross-linked polymeric material, for example, a cross-linked aromatic polyamide. Suitably, the porous support material is comprised of a polysulfone. Polyamide thin-film composite membranes are more commonly used in reverse osmosis desalination plants since they typically have higher water fluxes, salt and organic rejections and can withstand higher temperatures and larger pH variations than asymmetric cellulose acetate membranes. The polyamide thin-film composite membranes are also less susceptible to biological attack and compaction. The reverse osmosis membrane should at least be capable of preventing significant amounts of dissolved solids from entering the treated low salinity water product stream while allowing the water solvent to pass across it. Preferably, the membrane of the reverse osmosis unit is a spiral wound membrane located within a housing.

A fourth method to produce clean process water is to electrolytically generate it from seawater. The electrolytically generated water can be generated either at the surface or on a submerged ROV. Submerged operations require the use of an electrical umbilical power line from the surface to the ROV, as described by the U.S. Naval Oceans Systems Command's Technical Document 1530, dated April 1989. One non-limiting example is Proton's HOGEN C Series C30 Proton Exchange Membrane (PEM) electrolysis unit, which can provide process water at a high purity.

High pressure hydraulic fluid can also be powered by the ROV's on-board hydraulic system and used to power a submerged high pressure waterjet intensifier pump. The hydraulic power attachment can be made through a standard ROV "hot-stab" port conforming to ISO 13628-8, titled "Remotely operated tools and interfaces on subsea production systems," or through standard quick-disconnect fittings, such as Parker FH Series Couplings, or similar hydraulic connections know to those skilled in the art. The waterjet pump can be mounted on the ROV or mounted as an accessory unit in a separate fixture that the ROV can pick up and put down as required. A sub-sea hot stab is known in the art and is a high pressure sub-sea connector that is typically used to connect into a fluid system for intervention/emergency operations. It is a substantially leak-free connection of an external hydraulic supply pump, and/or system. It is typically designed to be ROV activated. A sub-sea hot stab basically comprises two parts; a valve, and a tool that connects to the valve and functions it.

A battery can be used to provide sufficient electrical power to operate a prime mover that can drive the waterjet pump. The battery can be a primary or secondary chemical battery. Non-limiting examples of suitable battery technologies include, are lithium-ion, nickel cadmium, nickel-metal hydride, lead-acid, silver-zinc, etc. Thermal batteries are also suitable for use herein, non-limiting examples which include lithium-iron disulfide, sodium-sulfur, and sodium-nickel chloride batteries.

A prime mover can also use stored chemical energy in the form of hydrogen peroxide ($H_2O_2$) to drive it. Hydrogen peroxide is a viable alternative energy storage medium, competing with hydrogen gas, biogas, biodiesel and alcohol. $H_2O_2$ is an energy-dense fuel that burns as cleanly as $H_2$, but requires no oxidizer since it is included inside the fuel. Actually, it does not burn, it decomposes, with a release of a large amount of energy, close to the energy per mole of $H_2$. It is like water, so it does not need a pressure vessel to contain it. It is "burned" in jets and other devices by catalytic decomposition. Hydrogen peroxide, when used to produce energy, creates only pure water and oxygen as a by-product, so it is considered a clean energy like hydrogen. However, unlike hydrogen, $H_2O_2$ exists in liquid form at room temperature, so it can be easily stored and transported. Hydrogen peroxide tends to decompose exothermically into water and oxygen gas. The concentration of hydrogen peroxide can be from about 20% to about 98% by weight, preferably between about 50% and about 68% by weight with the balance being water. An effective amount of a suitable catalyst is used to catalyze the reaction. Non-limiting examples of suitable catalysts include those selected from the group consisting of manganese dioxide, silver, platinum, and permanganates, preferably potassium permanganate. This reaction will generate sufficient hot gas (steam+$O_2$) so that the steam can be used to drive a prime mover such as a reciprocating or rotary engine, a turbine, rotary gas expander, or Wankel, engine.

Hydrogen peroxide can also be used in combination with a hydrocarbon that can also be used to drive the prime mover by combusting the hydrocarbon in the presence of oxygen, preferably oxygen is generated by passing an aqueous hydrogen peroxide solution over a suitable catalyst as mentioned above. The reaction will generate sufficient oxygen to combust the hydrocarbon, preferably ethanol, etc., along with steam that can be used to drive a prime mover or used directly drive a waterjet intensifier pump. As an example, three moles of oxygen from the hydrogen peroxide is used to oxidize one mole of hydrocarbon in the stoichiometric oxidation of the hydrocarbon into carbon dioxide and water vapor. Wider hydrocarbon-oxygen ratios can be used as desired.

Stored compressed or liquefied oxygen and a hydrocarbon can be used wherein the hydrocarbon can be thermally oxidized in an internal combustion engine with an effective amount of the stored compressed or liquefied oxygen to power a prime mover that is used to drive a waterjet reciprocating pump, preferably a reciprocating pump. A hydrocarbon, such as ethanol, etc., can also be oxidized with stored compressed or liquefied oxygen in a fuel cell to drive an electric motor as the prime mover for a waterjet pump reciprocating pump. The fuel cell is preferably a proton exchange membrane fuel cell that is typically comprised of three segments, an anode, a cathode, and a polymer electrolyte membrane. The fuel cell operates by the chemical reaction of oxygen with a fuel, such as hydrogen or a hydrocarbon, to convert chemical energy into electricity using adjacent segments identified as the anode, the electrolyte, and the cathode. Two chemical reactions occur at the interfaces of the three different segments. The net result of the two reactions is that the fuel is oxidized, typically to water or carbon dioxide if a hydrocarbon is used with oxygen, and an electric current is created that can be used to power an electrical prime mover.

Oxygen can also be generated by the electrolysis of seawater using an electrolyzer run off of an ROV's electrical feed system using a Proton Exchange Membrane (PEM) electrolysis unit, such as a Proton HOGEN C Series or similar unit, and electricity from the ROV electrical umbilical power cord. The electrolysis of water yields two moles of hydrogen and one mole of oxygen for every mole of water disassociated by electricity. The seawater, under hydrostatic compression, will yield oxygen and hydrogen at substantially the same pressure as the hydrostatic backpressure. The compressed oxygen can be burned in an internal combustion engine, resulting in either reciprocating or rotary action which can act as a prime mover that can drive a reciprocating pump or to drive a hydraulic pump, external gear hydraulic pump to drive a waterjet intensifier pump. The generated oxygen can be used with a stored fuel supply, typically a hydrocarbon, such as ethanol, or with the co-generated hydrogen gas generated by the electrolysis of seawater as discussed above. The byproduct of the combustion of hydrogen and oxygen is water that can also be used as clean process water for use in waterjet pump.

The prime mover can also use stored chemical energy in the form of one or more inorganic metals, such as, but not limited to, lithium, sodium, potassium, etc., that are oxidized with a stored oxidant, such as, but not limited to, sulfur hexafluoride, to generate heat to drive a prime mover. For example, eight moles of lithium reacts with one mole of sulfur hexafluoride to yield 15.2 MJ/kg of heat energy. This heat energy can be used in a Brayton-cycle to heat gas for power generation or in a Rankine cycle to create high temperature steam for power generation, such as a steam turbine. Both the Brayton-cycle and Rankine-cycle are thermodynamic cycles well known in the art The resulting hot gas or steam can also be used to directly drive the abrasive waterjet intensifier pump. The proposed system can also use stored chemical energy in the form of a monopropellant containing both a fuel and a chemically bound oxidizer, such as, but not limited to a monopropellant formed from the mixture of 75% by volume propylene glycol dinitrate (PGDN), to which a desensitizer, such as 23% by volume dibutyl sebacate, and a stabilizer, such as 2% by volume 2-nitrodiphenylamine, have been added. The fuel is injected into a 20:1 compression diesel cycle engine at the rate of 100 ml/sec for a 75 kW engine. The decomposition of a monopropellant will generate sufficient hot gas to drive either a prime mover reciprocating or turbine engine or to directly power the underwater waterjet intensifier.

II—Supplying Abrasive to the Abrasive Waterjet Cutting Head

An abrasive entrainment waterjet starts out the same as a pure waterjet. But with an abrasive entrainment waterjet, the jet of water accelerates the abrasive particles to speeds fast enough to cut through very hard materials. The cutting action of an abrasive waterjet is two-fold. The force of the water and abrasive erodes the material, even if the jet is held stationary (which is how an object is initially pierced). Any suitable entrainment abrasive waterjet cutting head can be used in the practice of the present invention. FIG. 1A hereof is a simplified representation of such a cutting head which shows water inlet 10, jewel orifice 12, mixing chamber 14, abrasive inlet 16, mixing tube or nozzle 18 and nozzle nut 20. The high-velocity jet of water exiting the jewel orifice 12 creates a vacuum that pull abrasive from abrasive inlet line 16, which then mixes with the jet of water in mixing chamber 14 and it jetted out of the mixing nozzle 18. The cutting action is greatly enhanced when the abrasive waterjet stream is moved across the intended cutting path of the object. The ideal speed of cutting depends on a variety of factors, including but not limited to the hardness of the object being cut, the shape of the object, the waterjet pressure, and the type of abrasive. Controlling the speed of the abrasive waterjet cutting head is important to efficient and economical cutting.

Non-limiting examples of abrasive materials that are suitable for use in the present invention include glass, silica, alumina, silicon carbide aluminum-based materials, garnet, as well as elemental metal and metal alloy slags and grits. Preferred are garnet and aluminum-based materials. It is preferred that the abrasive particles have either sharp edges or that they be capable of fracturing into pieces having sharp cutting edges, such as for example, octahedron or dodecahedron shaped particles. The size of the abrasive particles may be any suitable effective size. By effective size, is meant a size that will not plug the cutting head and that will be effective for removing the material of which the targeted object to be cut is made from (typically a metal alloy, such a steel) and which is effective for forming a substantially homogeneous mixture with the fluid carrier. Useful particle sizes for the abrasive material will range from about 3 mm to 55 microns, preferably from about 15 mm to 105 microns, and most preferably from about 125 microns to about 250 microns.

There are several ways in accordance with the present invention for the abrasive to be incorporated into the waterjet cutting head without jamming or plugging. For example, in shallow water, a surface vessel can supply dry abrasive via a hose down to the waterjet cutting head. A braided metal hose is preferred to prevent the hose from crushing under hydrostatic pressure. The aspiration of the mixing chamber in the entrainment abrasive waterjet cutting head will provide sufficient suction at depths to approximately 90 m (300 ft.).

Also, a compressed air line from a surface vessel or shore installation can supply dry compressed gas, preferably air or nitrogen, to an abrasive feed and metering system in the proximity of the submerged waterjet cutting head. The abrasive feed and metering device will preferably have an effective reservoir of dry abrasive and an abrasive metering unit to deliver a measured amount of abrasive to the waterjet cutting head. A typical consumption rate of abrasive in an entrainment abrasive waterjet cutting head is about 0.002 kg/second (0.2 lb/minute) to about 0.38 kg/second (5 lb/minute). Given that an entrainment abrasive waterjet cutting head will typically have a 25% duty cycle, the preferred submerged reservoir will preferably contain 80 to 100 kg of abrasive to operate for an eight hour shift. At a bulk density of 2,355 kg/cubic meter (147 lb/cubic foot) the abrasive reservoir's volume will preferably be 0.035 cubic meters (1.224 cubic feet). Naturally, the size could be either increased or decreased due to other design requirements.

The pressurized gas abrasive feed and metering system monitors the seawater hydrostatic backpressure at the abrasive waterjet cutting head to maintain the internal air or gas pressure in the abrasive system at a higher pressure, preferably about 125 Pa to 7 kPa higher, than the surrounding water pressure by means of a differential pressure sensor. The sensing of the hydrostatic backpressure needs to be close to real-time as surface waves can induce variations in the hydrostatic pressure field. Although the effect is more pronounced at shallower depths, the passage of a wave or surface vessel overhead will substantially change the hydrostatic pressure at the abrasive waterjet cutting head.

An excess of internal air or gas pressure in the abrasive system will try to force an excess amount of abrasive into the abrasive waterjet cutting head, which is both wasteful and can potentially plug the abrasive waterjet cutting head. Too little internal air or gas pressure in the abrasive feed and metering system will allow seawater to enter the abrasive waterjet cutting head and flow into the abrasive feed and metering system potentially causing a plug in the abrasive waterjet cutting head.

The pressurized gas abrasive feed and metering system monitors the differential pressure of the seawater hydrostatic backpressure at the abrasive waterjet cutting head to maintain the internal air pressure in the abrasive system at a higher pressure, preferably about 125 Pa to 7 kPa higher than the surrounding water pressure. The hydrostatic backpressure can be determined by any suitable conventional means. For example, it can be determined electronically by use of a differential pressure transducer operating one or more air control valves, or mechanically by a differential pressure valve controlling the supply of pressurized gas. For example, an electronic pressure transducer mounted within the abrasive reservoir can be used to measure the pressure within the reservoir and a second electronic pressure transducer can be located at the abrasive waterjet cutting head to measure the ambient seawater pressure. The electronic control system is preferably a microprocessor based unit. The electronic control system is preferably set to generate about 5 to 1000 Pa, preferably from about 125 to 7000 Pa differential overpressure between the electronic pressure transducer inside the abrasive reservoir sensor and the electronic pressure transducer at the cutting head. The control signal from the microprocessor will open the air supply valve to allow sufficient pressurized gas to enter the reservoir to achieve the desired differential overpressure as the pressurized gas is being consumed in the transport of abrasive to the abrasive waterjet cutting head.

Alternatively, a mechanical differential pressure gauge can be used with a spring biased diaphragm sensing the pressure within the abrasive reservoir on one side and the ambient seawater pressure at the abrasive waterjet cutting head at the opposite side. The bias spring can be adjusted to provide the desired differential overpressure in the abrasive reservoir over the ambient seawater pressure. Movement of the internal diaphragm will mechanically actuate the pressurized gas supply valve to allow sufficient pressurized gas to enter the abrasive reservoir to achieve the desired differential overpressure as the pressurized gas is being consumed in the transport of abrasive to the abrasive waterjet cutting head.

As an alternative to a large abrasive reservoir being submerged, a smaller reservoir can be used and periodically refilled using a dedicated abrasive supply line, or the same airline that supplies compressed gas by adding abrasive to the airline. An abrasive bypass valve can be actuated by the abrasive control system to allow the abrasive to bypass the air pressure regulator and go directly into the abrasive reservoir.

Another alternative to using compressed gas from the surface is to use dry compressed gas that can be supplied as a compressed or liquefied gas in an appropriate pressure storage vessel co-located with the submerged abrasive waterjet cutting head and metered through a pressure reduction valve. The pressure reduction valve can be either a single stage or double stage reduction valve. A double stage reduction valve can be thought of as two single stage valves in series with different set points. The reduction valves work by having an adjustable spring biased diaphragm that mechanically moves in relationship to the pressure applied on each side of the diaphragm. The spring bias allows for setting a specific pressure. When pressure is applied to one side of the diaphragm, it moves and pushes on its control linkage causing an increased flow and pressure of pressurized gas until the amount of pressure balances out the spring bias. In the case of a two stage gas regulators, the initial valve is preset and is not typically adjusted in the field. The advantage of using a two-stage gas regulator is a more constant gas pressure as compared to a single stage regulator.

Compressed dry gas for the abrasive system is preferably substantially oxygen-free, more preferably nitrogen or argon, to minimize the effects of compressed oxygen on combustible materials, such as propellants, explosives, or pyrotechnics. The substantially oxygen-free gas can be purchased from third party suppliers or it can be produced on site (on a surface ship) from the atmosphere by use of any suitable gas separation technology. Non-limiting gas separation technologies that can be used include pressure swing adsorption (PSA), vacuum swing adsorption (VSA), membrane separation, or cryogenic separation. The separated gas is supplied by a gas supply line to the underwater abrasive waterjet cutting system.

PSA gas separation is well known in the art and can be used for the production of dry, oxygen-free nitrogen gas. It typically operates by using a solid adsorbent to preferentially adsorb one or more target gases from compressed air. Typical adsorbents include activated carbon, silica gel, alumina and zeolite. When the pressure is released, the adsorbed target gas (nitrogen in this case) is desorbed and is available for recompression and use.

VSA gas separation is also well known in the art and can also be used for the production of dry, oxygen-free nitrogen gas and generally works by drawing air through the adsorption and separation process with a vacuum and discharging the desorbed nitrogen gas at atmospheric pressure for compression and use.

Membrane separation of dry, substantially oxygen-free nitrogen can be accomplished by using a nonporous polymeric membrane that is specifically designed to allow air to be separated because of their different solubility and diffusivity in the polymers. Porous membranes can also be used that allow the smaller oxygen and water vapor molecules to diffuse through the polymer and be rejected out of its side walls while allowing nitrogen to flow through its center and emerge as the feedstock for the gas compressor.

Cryogenic manufacture of dry, oxygen-free nitrogen or argon gas is also well known in the art and is based on the liquefaction of air to form a cryogenic liquid mixture containing nitrogen, argon, and oxygen. The two major methods of liquid air manufacturing are by either the Linde or the Claude process where compressed gas is cooled by adiabatic expansion based on the Joule-Thompson effect. The liquid air at −195° C. (−319° F.), is then fractionally distilled by boiling off the nitrogen at −196° C. (−321° F.), the argon at −185.85° C. (−302.53° F.), and the oxygen at −182.95° C. (−297.31° F.). The released pure nitrogen can then be compressed and delivered to the submerged abrasive feed system as discussed above.

Another alternative to using compressed gas is to use an on-board, pressurized, water electrolyzer that can generate hydrogen and oxygen gases from the surrounding seawater using electricity from a submerged ROV and conventional water electrolysis technology. For example, hydrogen and oxygen gases can be made using a Proton Exchange Membrane (PEM) electrolysis unit, or similar, and would use electricity from the ROV's electrical umbilical power cord. The electrical power source is connected to the electrolysis unit where two electrodes, or two plates (typically made from some inert metal such as platinum, stainless steel or iridium) are placed in the water. Hydrogen will appear at the cathode (the negatively charged electrode) and oxygen will appear at the anode (the positively charged electrode). As previously mentioned, the electrolysis of water yields two moles of hydrogen and one mole of oxygen for every mole of water disassociated. The seawater, under hydrostatic compression, will yield these gases at substantially the same pressure as the hydrostatic backpressure. The water pressure is increased using a pump to raise the pressure of the process water above ambient pressure by about 7 kPa to 1 MPa.

Since the increase in water pressure will generate gases at essentially that same pressure, the generated gases from the electrolyzer can then be stored at pressures higher than ambient hydrostatic pressure and controlled by a gas regulator to meet the desired differential overpressure. The generated gases can be made as required or made intermittently and stored for consumption by the abrasive system. The gases are preferably dried by any conventional technique prior to use, in substantially the same manner as compressed air would be from a surface vessel.

The drying of compressed gases can be done by any suitable conventional means. Non-limiting examples of such suitable means include the use of refrigeration, membrane dryers, and desiccant dryers. Refrigeration dryers work by chilling the compressed air to a target temperature, based on the end use temperature that causes any moisture to condense and be removed prior to delivery to the submerged abrasive waterjet abrasive waterjet cutting head. Refrigeration drying is applicable for drying compressed air at dew points of approximately 3° C. (37° F.), which is approximately the temperature of the deep ocean. In membrane dryers, compressed air is typically first filtered with a high-quality coalescing filter. This filter removes liquid water, oil and particulate from the compressed air. The water vapor-laden air then passes through the center bore of hollow fibers in the membrane bundle. At the same time, a small portion of the dry air product is redirected along the outside surface of the fibers to sweep out the water vapor which has permeated the membrane. The moisture-laden sweep gas is then vented to the atmosphere, and clean, dry air is supplied to the application. The membrane air dryers are designed to operate continuously, 24 hours per day, 7 days per week. Membrane air dryers are quiet, reliable and require no electricity to operate. Membrane air dryers depress the incoming dew point. Most dryers have a challenge air dew point and pressure specification. So if the inlet dew point is lower than the specified challenge air then the outlet dew point is even lower than specified. For example, a dryer could be rated at a −40° F. dew point with a challenge of +70° F. dew point and 100 psig. If the incoming air has an inlet dew point of only 32° F., the outlet dew point will be somewhat less. Pressure also plays a role. If the pressure is higher than the rated specification then the outlet dew point will be lowered. This lowering of the outlet dew point is due to the longer residence time that the air has inside the membrane. Using the spec above, an operating pressure of 120 psig will yield a lower outlet dew point than specified. The extent of the improvement is dependent on the nature of the membrane and could vary among manufacturers.

For desiccant dryers, the compressed air is typically passed through a pressure vessel with two "towers" filled with a media such as activated alumina, silica gel, molecular sieve or other desiccant material. This desiccant material attracts the water from the compressed air via adsorption. As the water clings to the desiccant, the desiccant "bed" becomes saturated. The dryer is timed to switch towers based on a standard NEMA cycle, once this cycle completes some compressed air from the system is used to "purge" the saturated desiccant bed by simply blowing the water that has adhered to the desiccant off. The duty of the desiccant is to bring the pressure dew point of the compressed air to a level in which the water will no longer condense, or to remove as much water from the compressed air as possible. A standard dew point that is expected by a regenerative dryer is −40° C. (−40° F.), this means that when the air leaves the dryer there is as much water in the air as if the air had been "cooled" to −40° C. (−40° F.). Required dew point is dependent on application and −70° C. is required in some applications.

Suggested alternatives to water for creating a pumpable slurry with the abrasive includes incorporating the abrasive into a solid water soluble material, also sometimes referred to as a binder matrix. Non-limiting solid water soluble materials that can be used in the practice of the present invention include polyvinyl alcohols, so that a flexible strip, tube, or rod of abrasive plus binder matrix can be mechanically fed into a waterjet cutting head at a controlled rate determined by the abrasive feed control. The binder matrix will dissolve in the high pressure jet of water and disperse into the environment. The abrasive can also be mixed with a water soluble rheological modifying material as a binder matrix along with an effective amount of water so that a slurry of abrasive and binder matrix can be mechanically pumped into the waterjet cutting head at a controlled rate determined by the abrasive feed control system, preferably by use of a traditional piston, gear, or peristaltic pump, auger, etc. The rheological modifying material will dissolve inside of the high pressure jet of water and disperse into the environment.

In the general class of rheological modifiers, the term flocculation refers to a process in which particle aggregation is caused by high molecular weight polymers that, due to their size, are capable of simultaneously adsorbing on several particles, and not necessarily causing charge neutralization. At low solid contents, they increase abrasive settling rates in the slurry, but at high solid concentrations, they can prevent settling. Examples of flocculants include starches, gums, polyacrylamides, and polyalkylene oxides. Polyacrylamide-based polymers are the most widely used industrial flocculants.

The process in which fine particles aggregate as a result of neutralization of their surface charge to zero is known as coagulation. In the absence of any electrostatic repulsive forces, van der Waals attraction will dominate in such systems. Polymeric thickeners are also predominantly cationic. Examples of coagulants suitable for use herein include polyamines and cationic derivatives of various polymers.

The rheological modifier class known as "associative thickeners" or stablizers are low-molecular polymers, soluble in water, which are modified by hydrophobic groups, such as hydrophobically modified alkali soluble emulsion (HASE) polymers and linear telechelic materials, commonly referred to as HEUR polymers (hydrophobic ethoxylated urethane). As an example, HASE polymer latex has weight fractions of methacrylic acid, ethyl acrylate, and ethoxylated macromonomer of 40:40:20, respectively. The thickening effect of this group is based on the interaction of the hydrophobic components of the thickener molecules with the hydrophobic components in the slurry, such as the abrasive particles. As a result of this interaction, a three-dimensional reversible physical cross-linking occurs in the dispersion, and a noticeable effect is an increase in viscosity.

"Non-associative" slurry thickeners comprise water soluble polymers with a high molecular weight that dissolve in the aqueous phase and create strong linkage with neighboring water molecules. The viscosity increasing effect of non-associative rheological additives is based primarily on the hydrodynamic volume exclusion (HDV) mechanism. Alkali Swellable Emulsions (ASE), which are the most common non-associative thickeners used in water-based systems, thicken by means of neutralization of acid groups along the polymer chain. With an increase in pH and subsequent neutralization, the acid portion of the polymer expands caused by charge repulsion.

Natural rheological modifiers or thickener can be polymers such as carregeenan, a naturally-occurring family of carbohydrates extracted from red seaweed; microcrystalline cellulose (MCC), derived from naturally occurring cellulose found in fruits and vegetables. Other materials include locust bean and xanthan gums.

Examples of dispersants, such as surfactants to reduce the resistance of the slurry to flow, include dextrins, polysaccharides, polyphosphates, polyacrylates, and polysilicates or water glass. Commercial polymers of a given chemical class are available in molecular weights ranging from a few thousand to more than 20 million. It is important to realize that within the same chemical group (e.g. polysaccharides), low molecular weight homologues are likely to behave as dispersants (dextrins), while high molecular weight counterparts will act as flocculants (e.g. starches).

Combinations of rheological enhancers, or thickeners to increase the viscosity of the slurry, along with dispersants can also be used. In the rheological terminology the term "dispersants" is used in a broader sense to denote all reagents whose addition reduces the viscosity and yield stress of concentrated solid-liquid suspensions. Compatible mixtures of dispersants and thickeners can be used to form thixotropic non-Newtonian slurries, where the viscosity of abrasive slurries of high solids content is reduced using dispersants and this viscosity is kept reduced as long as shearing is maintained. However, in non-shearing conditions, such as during storage, pump failure and/or system disruptions, the slurry is stabilized to avoid the sedimentation of the abrasive particles. The addition of high molecular weight polymers produces non-Newtonian systems with a measurable yield stress and increased viscosity.

It is also within the scope of this invention that a hydrophobic material be used as a matrix for forming a pumpable slurry with the abrasive. Non-limiting examples of such matrix materials suitable for use herein include aliphatic hydrocarbons having a carbon number between about 6 and 20, preferably between about 10 and 14, petroleum oils, animal oils, and plant oils, preferred are hydrophobic oils, more preferred are petroleum oils. The hydrophobic material is incorporated with the abrasive to form a slurry that can be mechanically injected into the abrasive waterjet cutting head at a controlled rate. This can be determined by an abrasive feed control system using a conventional piston, gear, or peristaltic pump, auger, etc. A piston pump is preferably used for conducting the abrasive slurry into the cutting head by compressing the slurry with a piston using pressure supplied by a hydraulic piston, an electrically driven rack or threaded shaft, or a hydraulically driven rack or threaded shaft.

The discharge rate of the piston pump can be controlled by the abrasive feed control system by varying the duty cycle or by varying the electricity or the hydraulic pressure applied to the piston pump motor. The discharge rate can also be controlled by pumping the slurry through an orifice having a bypass loop for excess slurry. The ratio of abrasive to hydrophobic material will be an effective ratio. By effective ratio we mean at a ratio that will enable the abrasive to become and stay substantially suspended in the hydrophobic material and that can be conducted, without substantial plugging, to the abrasive waterjet cutting head. It is preferred that the suspension be a substantially homogeneous suspension. Such ratio of abrasive to hydrophobic material by volume will be about 20:80 to about 80:20. An excess amount of abrasive, known as a "rich" mixture, is undesirable because it will create too much pressure on the slurry delivery system, while an excess of the hydrophobic matrix, known as a "lean" mixture, can cause the abrasive waterjet cutting head to be inefficient in cutting. The resulting liquid hydrophobic matrix is dispersed by the high pressure jet of water along with the abrasive in the mixing chamber of the abrasive waterjet cutting head and will form a solid-liquid-liquid jet upon exiting the abrasive waterjet nozzle with the abrasive, hydrophobic material, and water, respectively.

It is within the scope of this invention that the hydrophobic material be a solid or high viscosity liquid selected from greases, and waxy materials, such as, but not limited to, paraffin wax or beeswax. These solid materials incorporate the abrasive so that a flexible solid or semi-solid strip, tube, or rod, etc., of abrasive and binder matrix (solid material) can be mechanically fed into the abrasive waterjet cutting head at a controlled rate, under the control of the abrasive feed control system, by plastic deformation. Other non-limiting examples of such solids suitable for use herein include plant waxes, animal waxes, mineral jellies, mineral waxes, mineral soaps, mineral greases, and animal greases or mixtures thereof. The binder matrix is dispersed by the high pressure jet of water along with the abrasive in the mixing chamber of the abrasive waterjet cutting head and would form a solid-solid-liquid jet upon exiting the abrasive waterjet nozzle with the abrasive, hydrophobic matrix, and water, respectively.

Hydrophobic gels can also be used for the matrix for the suspension of the abrasives. Gels are comprised of a solid three-dimensional network that spans the volume of a liquid medium and ensnares it through surface tension effects. Non-limiting examples of hydrophobic gels suitable for use herein include hydrophobic silica gels modified with trimethylsilyl and long-chain alkyl (C6-C18) groups; hydroxypropyl beaded dextran that has been substituted with long chain (C13-C18) alkyl ethers; and polyethyleneglycol (PEG) end-capped with fluoroalkyl groups.

The above abrasive and hydrophobic matrix can be mechanically fed into the abrasive waterjet cutting head at a controlled rate. This can be done by any suitable means, such as by heating the hydrophobic matrix material until it is in a plastic or liquid state, using heat, preferably by electric resistance elements or heated process fluids, for example, from the ROV's hydraulic pump. The abrasive/hydrophobic matrix can then be pumped to the waterjet cutting head using any suitable conventional pump, such as a piston, gear, or peristaltic pump, auger, etc. The liquefied matrix is dispersed by the high pressure jet of water along with the abrasive in the mixing chamber of the abrasive waterjet cutting head and forms a solid-liquid-liquid jet upon exiting the abrasive waterjet nozzle with the abrasive, liquefied hydrophobic matrix, and water, respectively The abrasive mix can be metered using a programmable electronic or mechanical device, known as the abrasive feed control system that will allow precise control over the quantity of abrasive mix being fed to the abrasive waterjet cutting head. In one preferred embodiment a microprocessor-based system is used. A mechanical logic control system can also be used. Non-limiting types of mechanical logic control systems include fluidic, pneumatic, and mechanical logic processing.

The metering system for the abrasive mix can use a number of several types of feed systems. Non-limiting examples of types suitable for use herein include incremental feeders using a rotary screw auger, containing either a spiral blade coiled around a shaft, driven at one end and held at the other, or a shaft-less or center-less spiral flight, powered by electrical, mechanical, hydraulic, or pneumatic means under fixed control or under the control of the abrasive control system. The abrasive mix feeder can also utilize mechanical such as piston feed systems, or other increment feeders, such as belt feed, bucket feed, reciprocating feed, or oscillating feed, etc.

The abrasives used in the practice of the present invention can be paramagnetic. Non-limiting examples of paramagnetic abrasive materials that can be used in the practice of the present invention include pure crystals or crystalline mixtures of pyrope, almandine, spessarite, silicon carbide, etc., exhibit paramagnetism and will react to magnetic fields. Paramagnetic abrasives can also be metered by using a rotating magnetic disk or cylinder, using either electromagnetic or permanent magnets, that will feed a measured flow of paramagnetic abrasive mix based on the rotating speed and/or magnetic flux under the control of the above mentioned abrasive control system.

The flow of abrasives to the abrasive waterjet cutting head must be a substantially constant, uniform flow despite changes in temperature and pressure in the abrasive reservoir. The abrasive metering device must be able to control the flow of abrasive and meter it uniformly into the abrasive waterjet cutting head or its abrasive delivery tube.

Figure 2A:
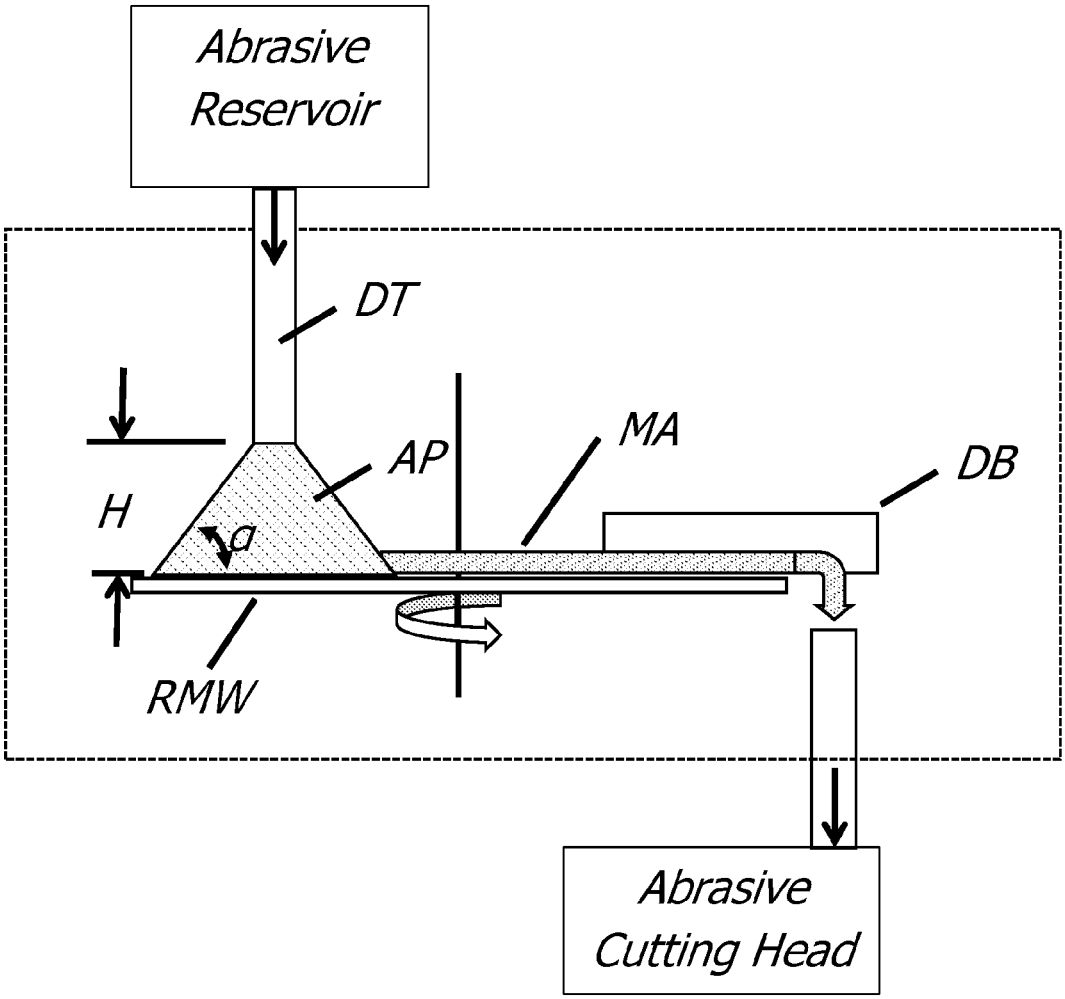
FIGS. 2A to 2C hereof are simplified representations of preferred embodiments for preventing plugging of the abrasive material at the abrasive waterjet cutting head.
Figure 2B:
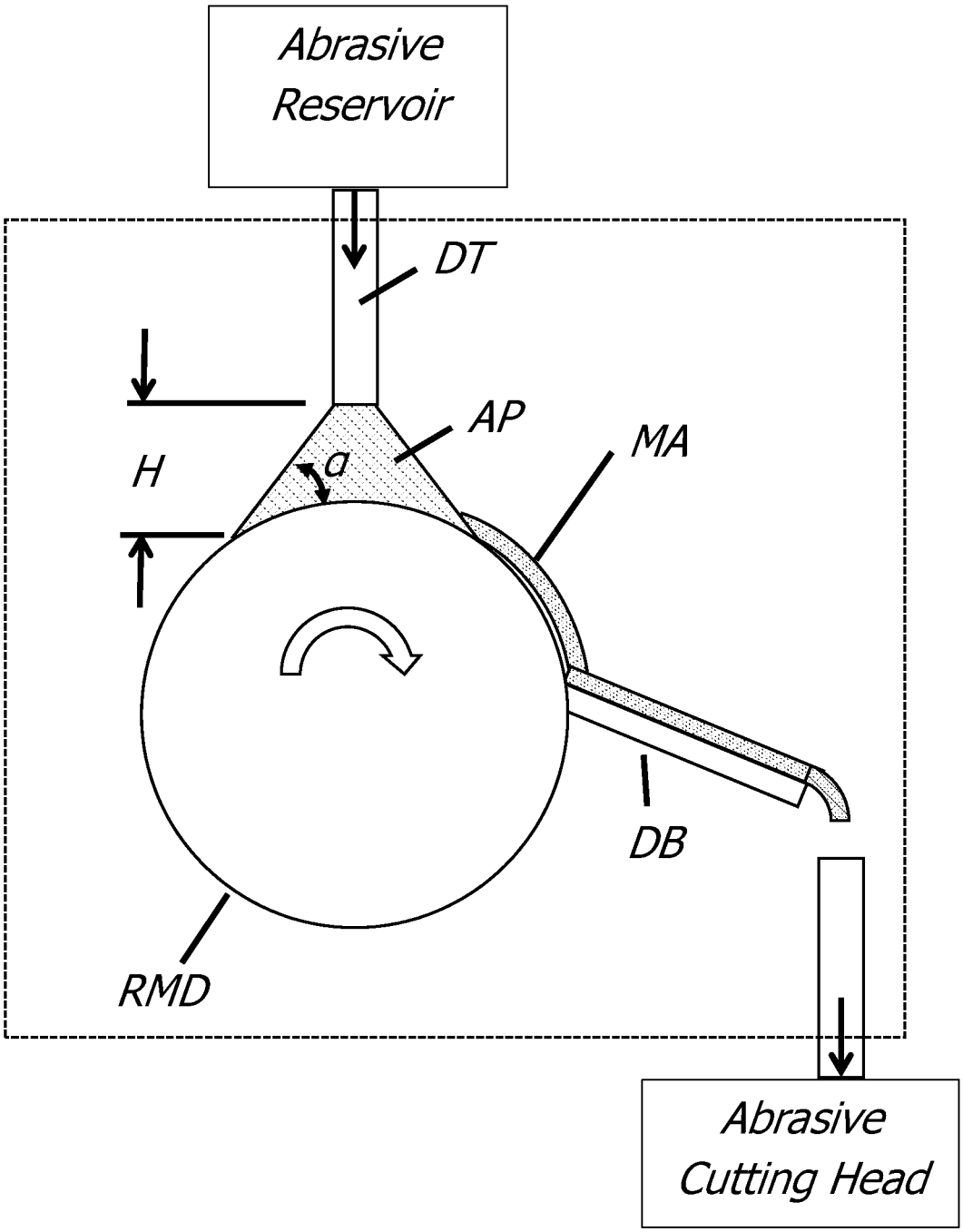

Reference is made to FIG. 2A hereof. Granular abrasive materials, when conveyed in a tube, shown as DT, to a horizontal surface will form a conical abrasive pile, AP, with a fixed internal angle between the surface of the pile and the surface. This internal angle, α, is known as the angle of repose and is related to the density, surface area and shapes of the granular particles, and the coefficient of friction of the material. The natural phenomenon of the angle of repose is commonly used in the industry to stop the delivery of abrasive from the abrasive reservoir by situating the delivery tube at some height H above the metering system so that the delivered abrasive's angle of repose blocks the continual delivery of abrasive. A rotating magnetic wheel, RMW, or a rotating magnetic drum, RMD, as shown in FIG. 2B hereof can then strip metered abrasive, MA, off of the abrasive pile at a substantially constant rate, depending on the angular velocity and the coercive magnetic force. A doctor blade, DB, can be used to separate the metered abrasive, MA, from the rotating magnetic wheel, RMW, or a rotating magnetic drum, RMD, or the magnetism can be interrupted. The abrasive reservoir will continue to replenish the abrasive until the angle of repose, a, in the abrasive pile, AP, is established again.

Figure 2C:
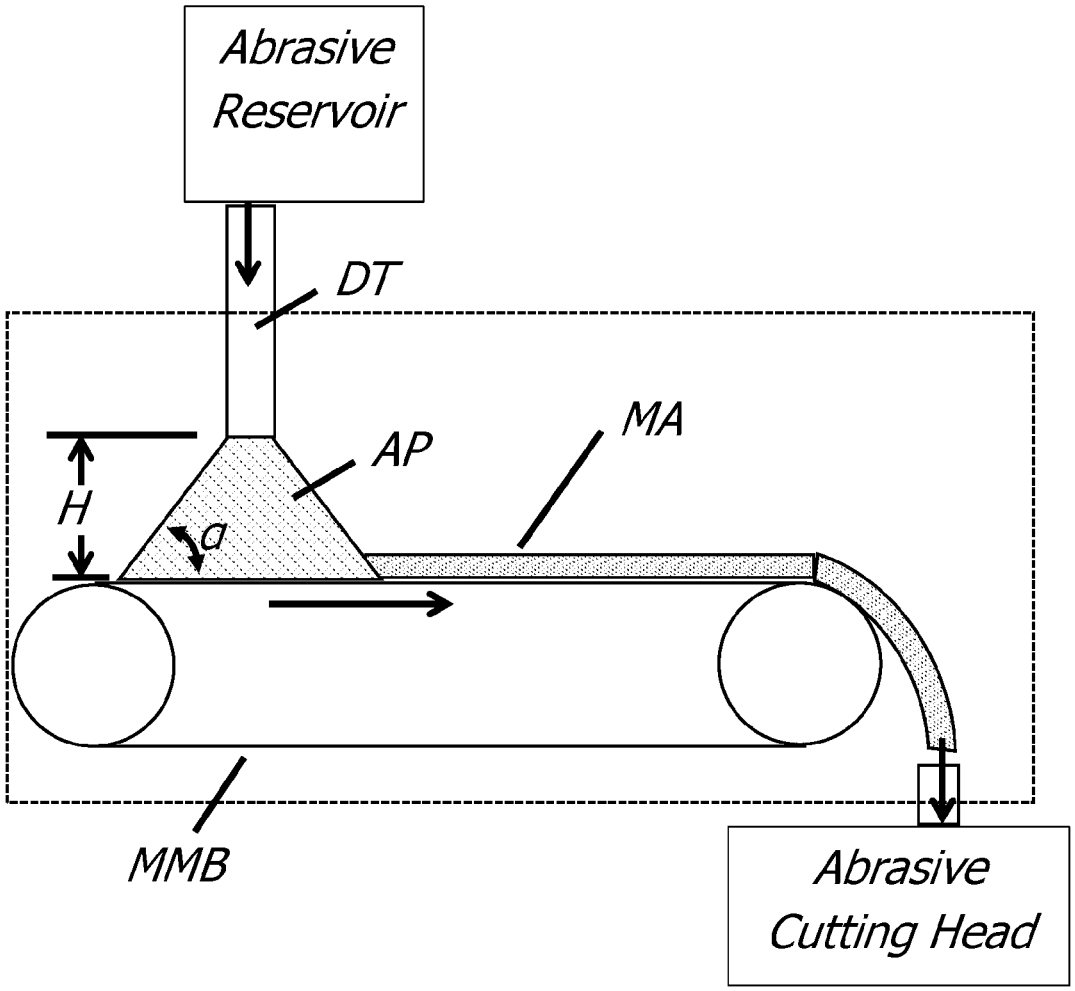
Figure 3A:
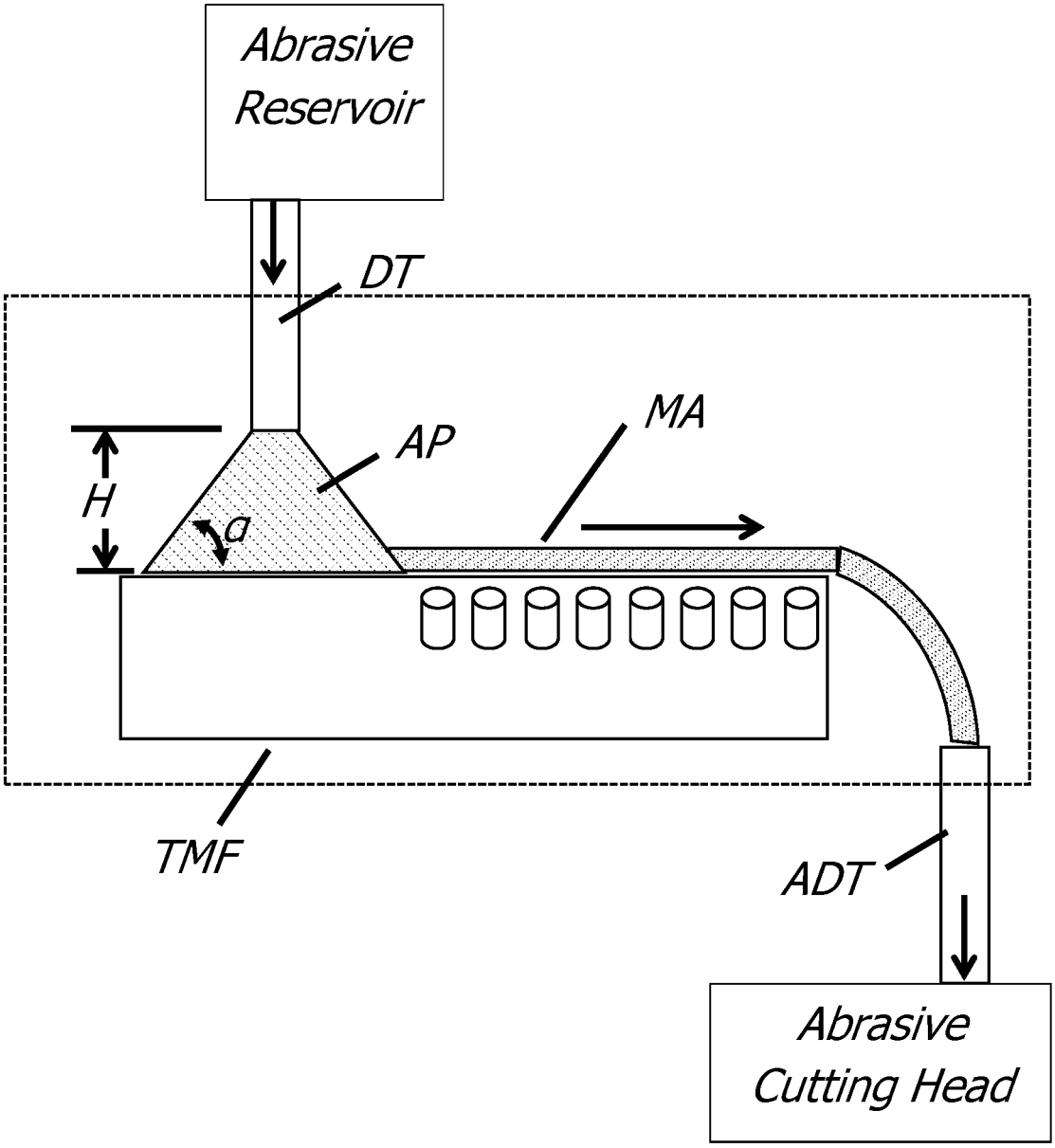
FIG. 3A hereof is another simplified representation of a preferred embodiment for preventing plugging of the abrasive material at the abrasive waterjet cutting head.
Figure 3B:
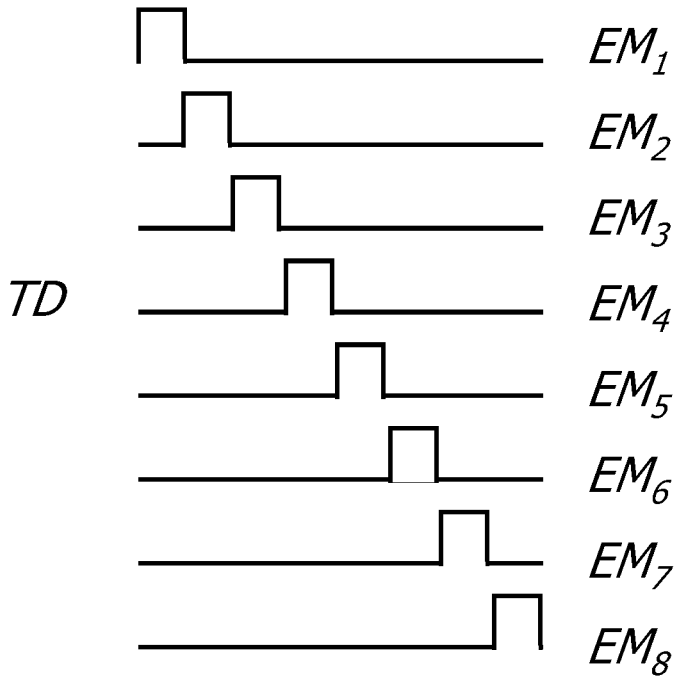
FIG. 3B hereof is a representation of how electromagnets can be used to produce a traveling magnetic field to prevent abrasive plugging and that are sequentially and repeatedly activated.

Alternatively, the paramagnetic abrasive can be fed using a moving magnetic belt, MMB, as represented in FIG. 2C hereof, either incorporating embedded magnets or a magnetic field generated beneath the belt formed by either electromagnetic or permanent magnets under the control of the above mentioned control system. Yet another method, as represented in FIG. 3A hereof, is by metering paramagnetic abrasives with a traveling magnetic field, TMF, formed by a plurality of electromagnets, as a non-limiting example eight electromagnets are shown as $EM_1$ through $EM_8$, that are sequentially and repeatedly activated, as shown in timing diagram, TD, as represented in FIG. 3B hereof, to form a series of magnetic forces moving linearly down a tube, etc., in the form of a linear induction feeder also under the control of the above mentioned control system. The appropriate magnetic force can be from 0.1 Tesla (T) to 1 T and preferably between 0.25 T to 0.5 T.

Figure 4:
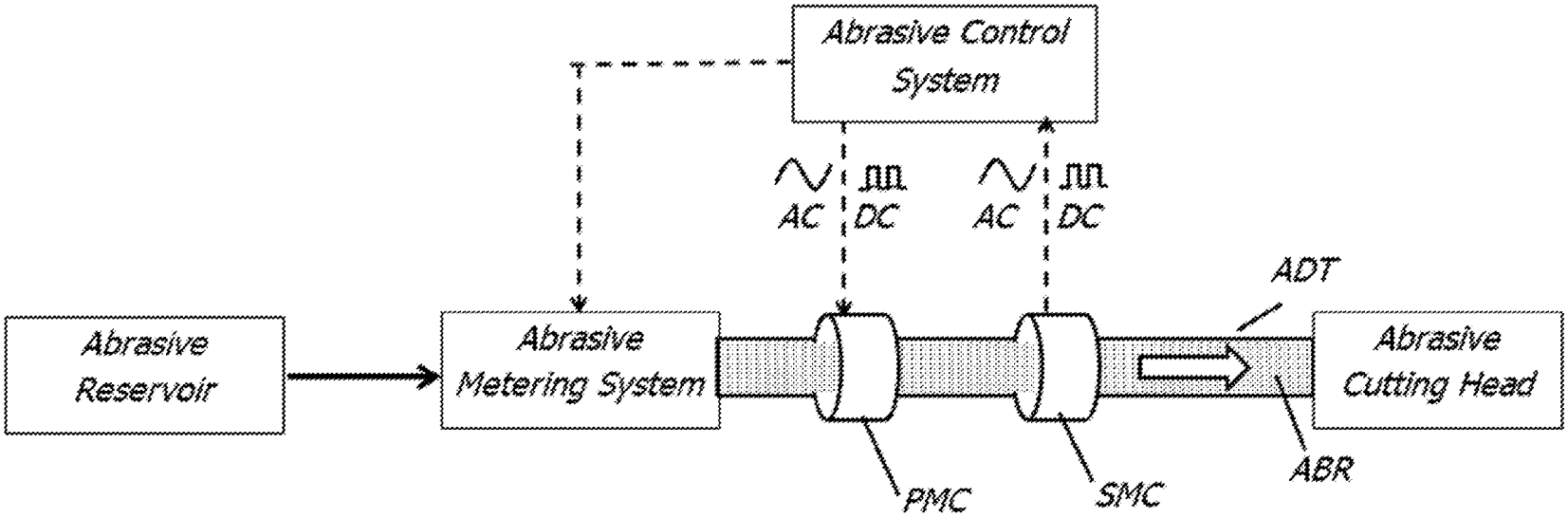
FIG. 4 hereof is a simplified representation of how an induced magnetic field is imposed on a flowing paramagnetic abrasive material by use of electromagnetic coils.

Paramagnetic abrasive mass flow rate can be measured, monitored, and the information provided back to the abrasive metering system using magnetic induction in a control feedback loop. Induced magnetic fields can be imposed on the flowing paramagnetic abrasive by electromagnetic coils as represented in FIG. 4 hereof. The electromagnetic coils, shown as PMC and SMC, either in alternating current (AC) or in direct current (DC) modes, or by use of permanent magnets, either stationary or rotating. Magnetic permeability (μ) or susceptibility (κ) are related properties and can be expressed as:

$$\mu=1+4\pi\kappa$$

Lines of magnetic force can be generated using alternating current in a primary coil (PMC) of wire and then the changing lines of magnetic flux can be used to create electric current in a secondary coil (SMC) of wire, known as a "pickup" coil that can "sense" the amount of magnetic flux. The greater the magnetic flux concentrating properties of the material between the in inducing and the sensing coil, known as the core—even if the core is only air, the greater the amount of magnetic flux is forced to pass through the secondary coil of the circuit. The published data on garnet abrasive, for example, shows that garnet has 0.4% of the magnetic susceptibility of iron, or approximately 2.512× 10^−5H m^−1 (henrys per meter). Therefore, the abrasive (ABR) flowing through the center of a primary coil, inducing magnetic flux in the paramagnetic abrasive, and then through a secondary pickup coil increases the magnetic flux substantially over a null or air coil non-flowing condition. The change of abrasive mass flux can be measured in the secondary coil as either a change in electrical inductance or in electrical current. The use of one or more electric sensing or pickup coils on the abrasive delivery tube (ADT) downstream, in relationship to the abrasive flow direction from the abrasive metering system, will yield an electric output proportional to the mass of the magnetized abrasive flowing through the coils. One or more coils can be used for increased accuracy or redundancy. A feedback loop from the paramagnetic abrasive mass flow meter to the abrasive control system can vary or modulate the mass of abrasive flowing to the abrasive waterjet cutting head to provide optimum cutting performance and to prevent plugging of the abrasive feed line or cutting head.

III—Preventing Plugging or Jamming of the Abrasive Waterjet Cutting Head

Figure 5A:
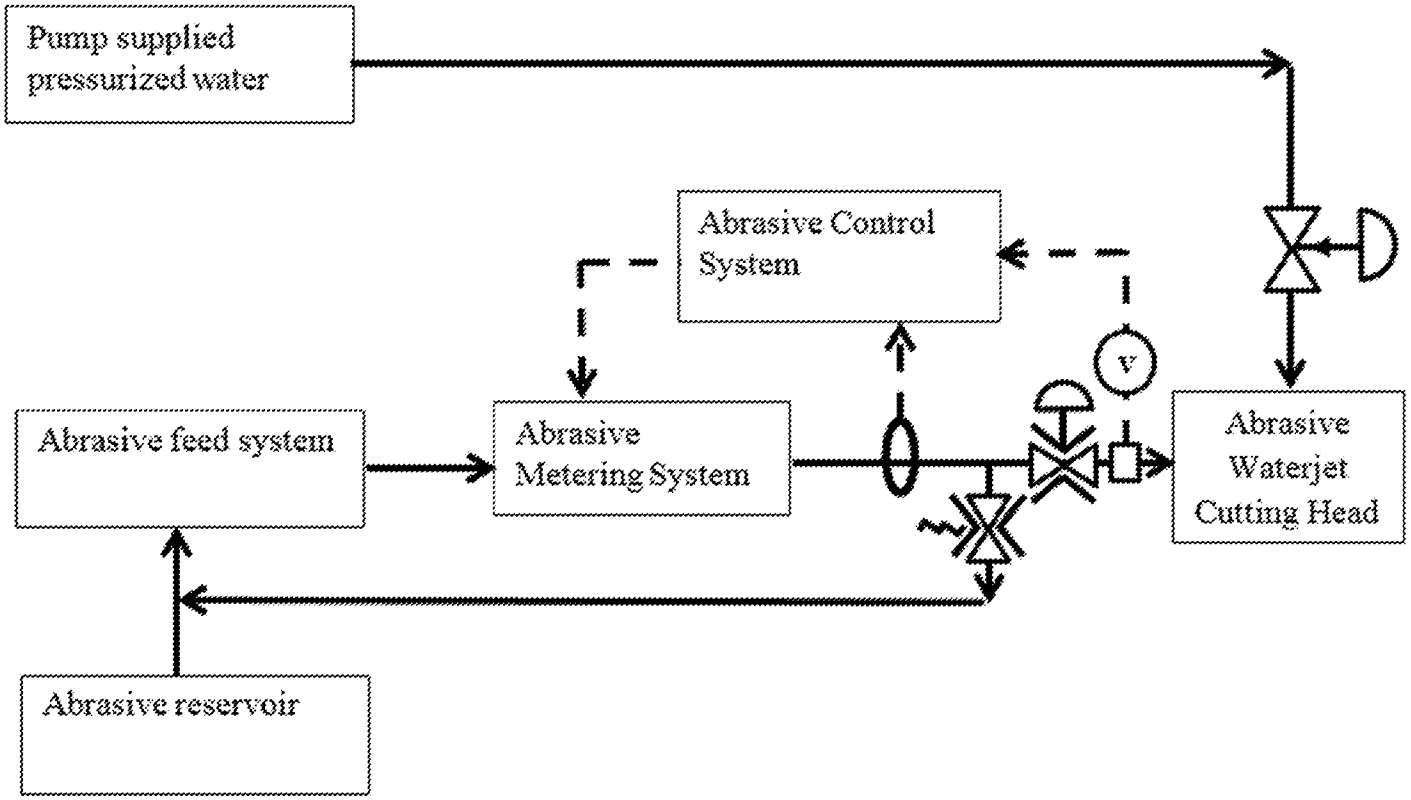
FIGS. 5A, 5B, and 5C represent preferred embodiments for controlling the mass flow of abrasive and preventing plugging of abrasive at the waterjet cutting head.

The metered feeding of abrasive into the abrasive waterjet cutting head is important for the operation of the abrasive waterjet cutting head and the cutting operation. Consequently, a method to prevent plugging of the abrasive in the feed and metering system to the abrasive mixing chamber of the cutting head is required. Such methods can include one or more of the following concepts:

(A) The plugging of the abrasive mix can be minimized by using a continuous loop feed system as illustrated in FIG. 5A hereof that continuously feeds the abrasive mix from the abrasive feed and metering system to the abrasive waterjet cutting head and returns an unused portion of abrasive mix back to the abrasive feed and metering system. A substantially constant flow of abrasive mix will minimize the likelihood of abrasive settling or plugging.

Figure 5B:
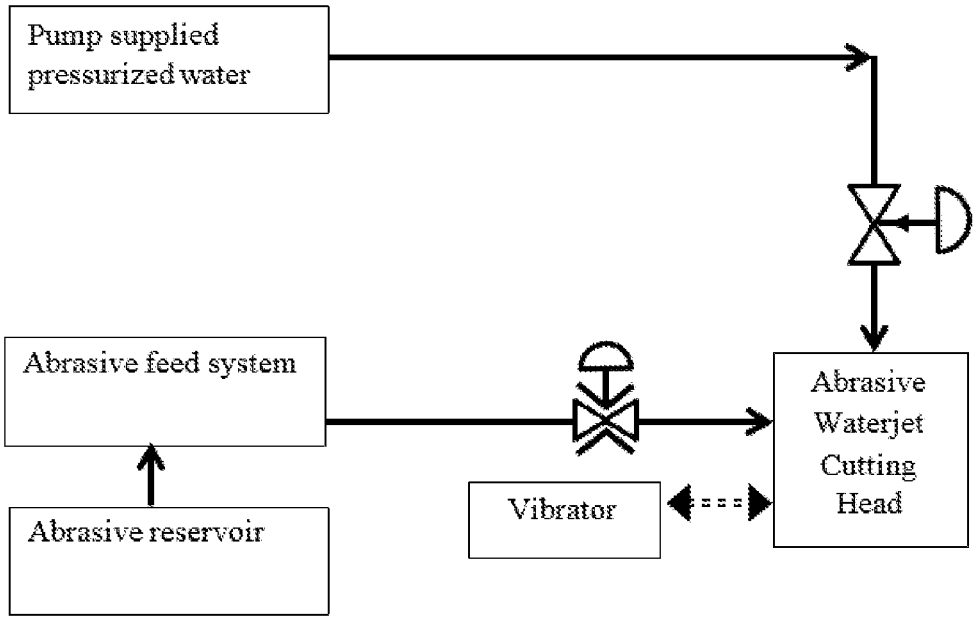

(B) The plugging of abrasive mix can be minimized by the addition of mechanical vibration as illustrated in FIG. 5B hereof at the abrasive waterjet cutting head to prevent agglomeration of abrasive particles. The vibration can be applied by any suitable conventional means such as by use of electrical, hydraulic, or pneumatic power sources. In the case of electrically induced vibrations, the vibration can be induced by a rotary electric motor with an offset mass causing vibration during rotation; a rotary electric motor causing a cam to lift and drop a spring loaded mass; an electrical signal applied to a solenoid to act either as a linear oscillating mass or as an impacting mass; an electrical signal applied to an electromagnet causing acoustic vibrations; an electric signal applied to an electromagnet with the attracted core attached to a part of the abrasive waterjet cutting head causing oscillating vibrations. In the case of hydraulic or pneumatic systems, the vibration can be induced by a rotary hydraulic or pneumatic motor with an offset mass causing vibration during rotation; a rotary hydraulic or pneumatic motor causing a cam to lift and drop a spring loaded mass; or a hydraulic or pneumatic piston oscillating and acting as a linear oscillating mass or as an impacting mass. Other variations are also applicable. Vibration will also improve the cutting speed of the abrasive waterjet cutting process by preventing stagnation of the jet of water and abrasive at the cutting zone.

Figure 5C:
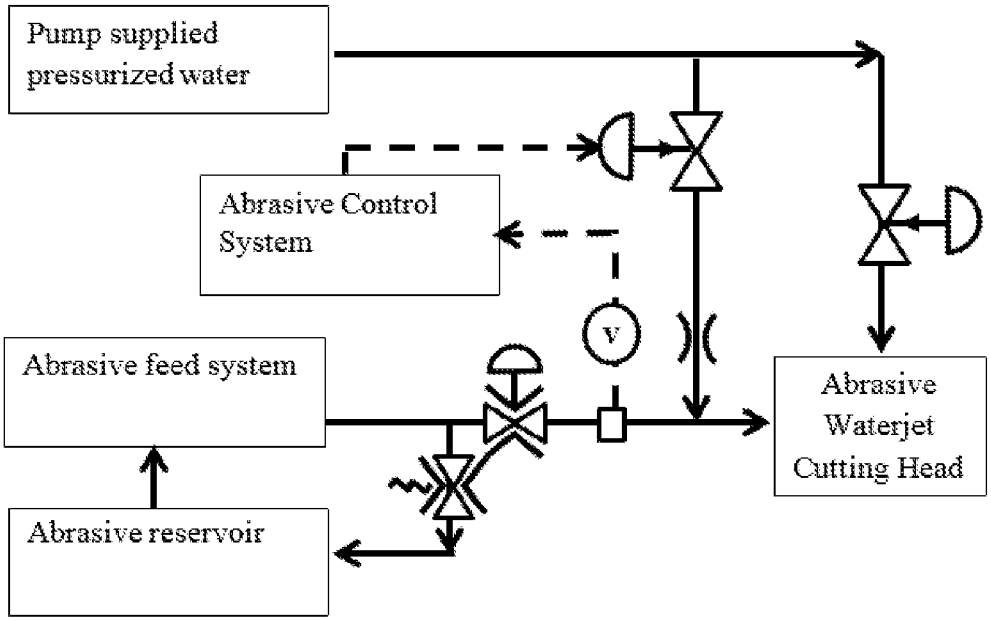

(C) An abrasive mix plug or jam, once detected, preferably by using a vacuum sensor to detect loss of vacuum formed by venturi action of the water jet, can be removed as illustrated in FIG. 5C hereof by upstream injection of supplemental water to dilute the abrasive mix using a by-pass stream of water from the high-pressure water delivery line. The high-pressure water is controlled by the abrasive control system, which injects an effective amount of water to dilute the abrasive mix and flush out any agglomeration.

Figure 6A:
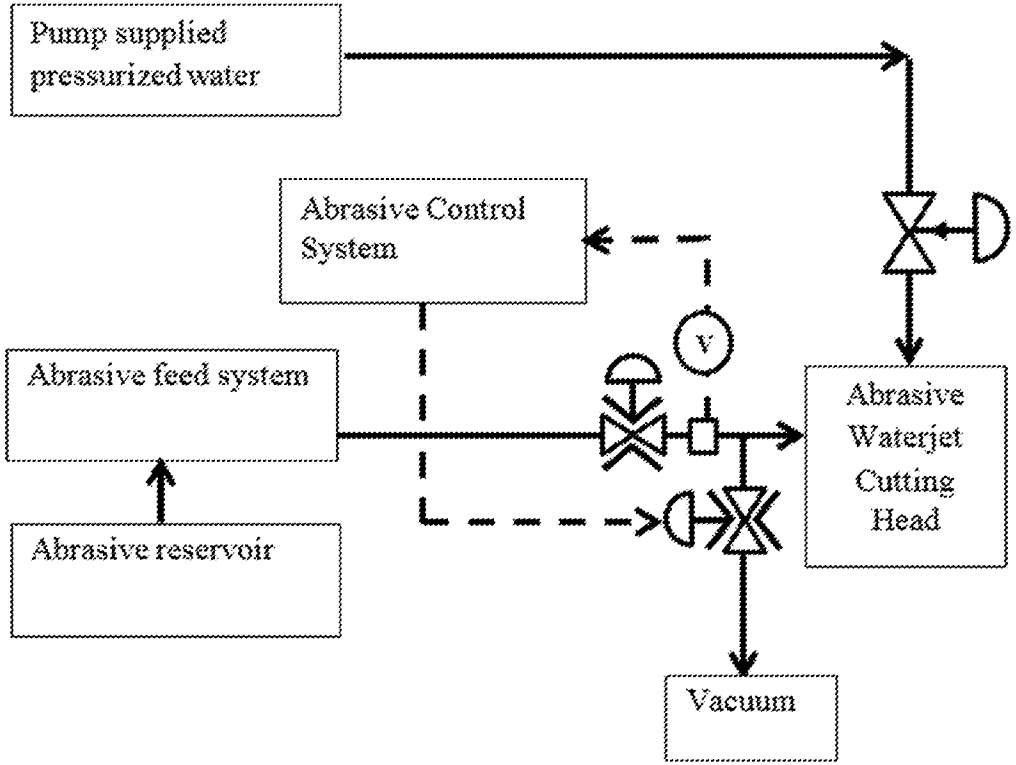
FIGS. 6A and 6B represent additional preferred embodiments for controlling the mass flow of abrasive and preventing plugging of abrasive at the waterjet cutting head.
Figure 6B:
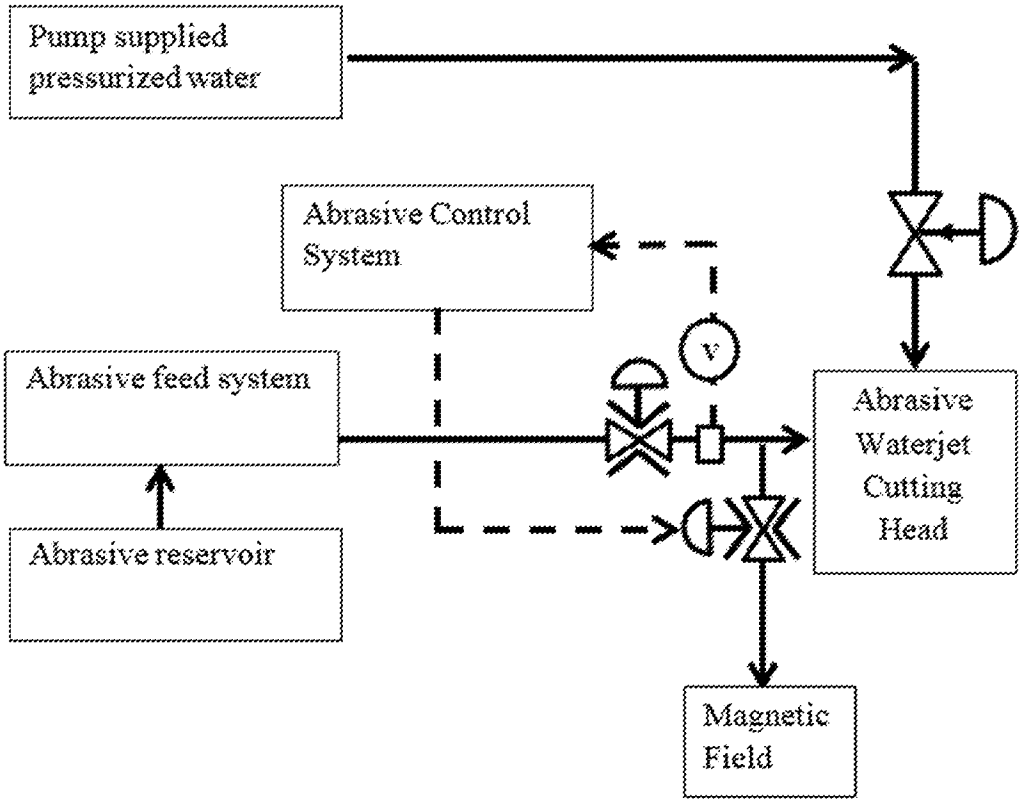

A plug of abrasive mix, once detected, can also be removed by the application of supplementary vacuum as illustrated in FIG. 6A hereof from another port near to the abrasive mixing chamber, or by supplementary vacuum on the continuous loop feed system. A plug of paramagnetic abrasive mix, once detected, can be removed as illustrated in FIG. 6B hereof, by the application of supplementary high level magnetic force from another port near to the abrasive mixing chamber, or by supplementary magnetic force on the continuous loop feed system if used.

IV Attaching the Abrasive Waterjet Cutting Head to the Targeted Object.

Although the abrasive waterjet cutting head can be held by either a human diver or ROV and moved along a cutting tract of the targeted object, it will, in most instances, need to be attached to the targeted object for an accurate cut to be made. The abrasive waterjet cutting attachment is accurately positioned in relation to the targeted object in order for the object to be properly cut and/or washed out. This positioning is complicated by such things as the reaction force of the waterjet, the local marine current, the encrustation of marine growth on the object, and the proximity of fragile marine flora and fauna that may need to be protected from collateral harm. Small objects to be cut, weighing less than approximately 5.4 kg (12 lb), may need to be immobilized to prevent movement during the high-pressure entrainment abrasive waterjet cutting process. Large abrasive waterjet cutters use waterjets yielding approximately 54 N (12 lbf) which can physically move smaller objects, especially underwater where the effect of lubricity and buoyancy is more pronounced than in air.

Figure 7A:
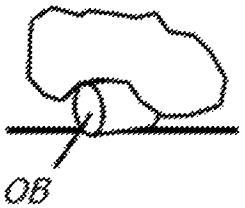
FIGS. 7A to 7G are simplified illustrations of preferred embodiments for immobilizing low mass underwater objects that would be susceptible to moving under the force of a waterjet cutting operation.
Figure 7B:
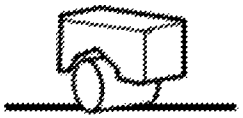
Figure 7C:
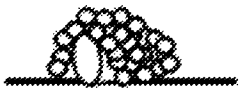
Figure 7D:
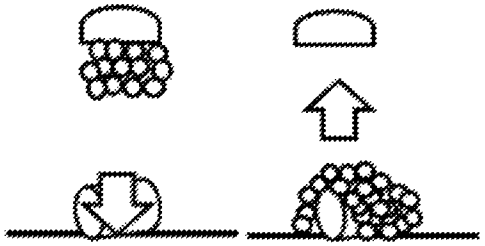

There are various methods in accordance with the present invention wherein lightweight objects can be immobilized for the cutting operation. Such methods are illustrated in FIGS. 7A to 7G hereof. For example FIG. 7A shows the placement of a bag filled with pellets and 7B shows a heavy weight contoured to fit the shape of the object to be cut. FIG. 7C shows a plurality of free-flowing pellets or stones and the like placed on top of the object, the pellets can be solid or a gel. FIG. 7D shows magnetic pellets or pellets comprised of a ferrofluid being lowered to the object by an electromagnet which releases the pellets so they rest on top of the object. These paramagnetic materials have the advantage of being recoverable after cutting by using an electromagnet or a permanent magnet on board an ROV.

Pellets can also be made of a high density fluid or slurry, preferably encapsulated, within a deformable polymeric shell. The polymeric shell can be formed from any suitable pliable polymer, preferably a silicone rubber, that will have a relatively low shore durometer hardness, preferably in the range of about 20 to about 100 Shore A, more preferably from about 50 to about 75 Shore A. The advantage of these deformable pellets is that they can more closely configure themselves to the contour(s) of the targeted object. The high density fluid or slurry can be made from magneto-rheological material(s), such as "ferrofluids," that will allow for the ability to recover the pellets with use of a magnetic force after the cutting process is finished.

Figure 7E:
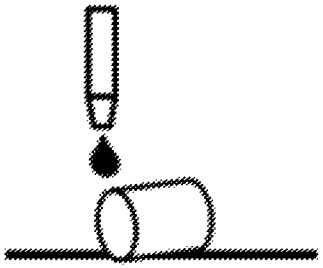
Figure 7F:
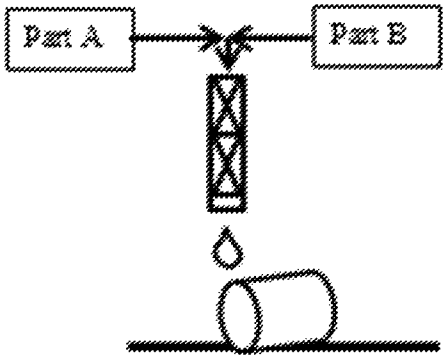

Another method for immobilizing a lightweight item underwater is by releasing a fast setting water-reactive material, such as hydraulic cement, as illustrated in FIG. 7E hereof. Such materials are relatively inexpensive and readily available. Non-limiting examples of hydraulic cements that are suitable for use in the present invention include are Portland and possolanic cements. Yet another method for immobilizing a lightweight object underwater is to release a two-part reactive material as shown in FIG. 7F hereof that doesn't react with water, such as epoxy or silicone, but which will immobilize the targeted item such as an underwater pipe or DMM.

Figure 7G:
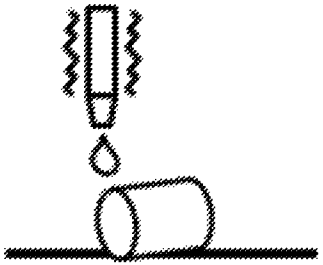

Finally, another method for immobilizing a lightweight object underwater is to release a plastic or thermoplastic material, such as hot-melt polyester adhesive as shown in FIG. 7G hereof. Such materials are liquefied by using a heat source, such as an electrical resistance heater or by using heat from hot hydraulic system oil, and applying them to the targeted object to adhere it to the sea floor or to provide sufficient mass to resist the effects of the waterjet.

Once the targeted object is immobilized, or is large enough so that it does not requiring immobilization, the abrasive waterjet cutting system can be attached to the targeted object by various methods. Prior to attaching the abrasive waterjet cutting head to an object that is covered with excessive marine growth or corrosion protuberances, the waterjet can be used to clean off the surface of the targeted object, thereby leaving a smoother surface.

In one embodiment of the present invention, the abrasive waterjet cutting head CH can be attached with a plurality of free-flowing pellets. FIG. 8A shows magnetic pellets or pellets comprised of a ferrofluid MP being lowered to the object by an electromagnet which releases the pellets so they rest on top of the abrasive waterjet cutting system. These paramagnetic materials have the advantage of being recoverable after cutting by using an electromagnet or a permanent magnet on board an ROV.

Another method for attaching the abrasive waterjet cutting head to the targeted object is to use magnetic attraction, either using electromagnets or permanent magnets as shown in FIG. 8B hereof. This method will only be used on ferromagnetic or paramagnetic targeted objects. This method can use either a conformal pad, typically made from polymeric materials, or a hard mount directly to the targeted object to achieve the desired attachment force of about 54 N (12 lbf) force. The conformal pad shore durometer hardness is preferably in the range of 20 to 100 Shore A, with 50-75 Shore A being most desirable.

Yet another method in accordance with the present invention for attaching the abrasive waterjet cutting head to the targeted object is by use of an adhesive AD as shown in FIG. 8C hereof. For example, an attaching an obturating ring can be made from a one or more part polymer material, such as polyurethane or polymethylmethacrylate (PMMA), that is catalyzed forming a conformal fit on the targeted object and would attaching to the abrasive waterjet cutting head assembly to the target item.

A fourth method is to use an adhesive material as shown in FIG. 8D hereof, dispensed from a delivery systems and applied to the targeted item to attach to the abrasive waterjet cutting head. Non-limiting examples of suitable adhesives include those of a thermoplastic material, such as ethylene n-butyl acrylate (EnBA), ethylene-acrylic acid (EAA), and ethylene-ethyl acetate (EEA), adhesives. The heat for softening the thermoplastic materials in the delivery system can be provided by any suitable conventional means, such as by electric resistance heating, hot fluid, such as hot hydraulic fluid, or by an exothermic reaction between two or more chemicals. The thermoplastic material is heated to a significantly higher temperature than its melting temperature so that it doesn't immediately freeze when injected in the cold seawater. The temperature the thermoplastic material is heated to will determine the speed the adhesive sets in the cold environment, but the temperature must be less than the thermoplastic material's decomposition temperature.

Figure 8G:
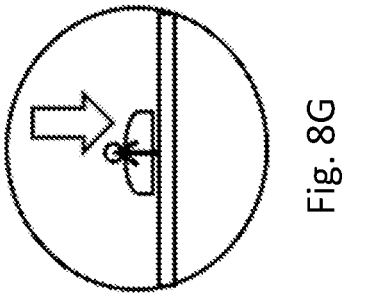
Figure 8F:
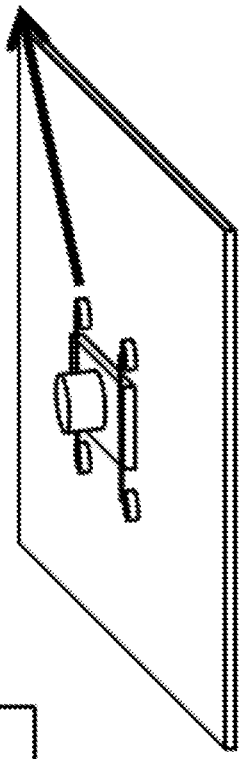
Figure 8E:
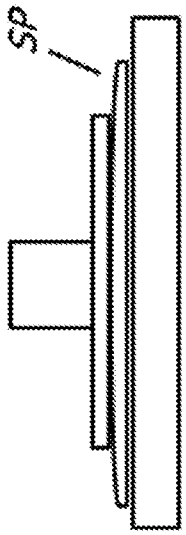

In another embodiment of the present invention, the abrasive waterjet cutting head can be attached by use of underwater suction pads SP, either contoured to fit the general configuration of the targeted object as illustrated in FIG. 8E hereof, or of a commercial configuration that is small enough, as shown in FIGS. 8F and 8G hereof, to allow sufficient pad attachment surface area to withstand the reaction force of the abrasive waterjet. A nominal attachment force is about 54 N (12 lbf), but can vary due to the size of the abrasive waterjet orifice and/or water pressure. The suction pads can be actuated by inducing a lower pressure within the pad area via a pump or by a retractable piston, creating a lower pressure within the pad area. As a non-limiting example, using a 40×80 mm Vuototecnica VES 40 80S silicone vacuum pad with 17 kPa (2.5 psi) pressure differential between the inside and outside of the pad will give an attachment force of about 54 N (12 lbf). The conformal area of the suction pad also provides a seal to prevent or minimize the egress of materials from the targeted item from entering the environment.

Figure 8I:
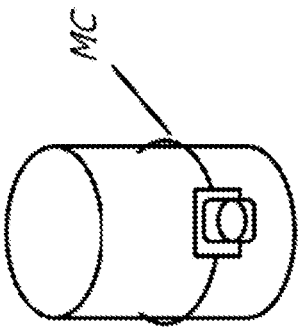
Figure 8H:
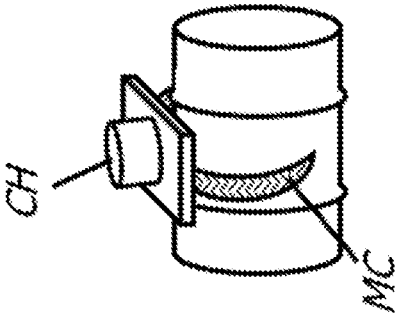

Yet another class of attachment devices is to use mechanical means to attach the abrasive waterjet cutting head assembly to the target object. These methods include using mechanical clamps, as shown if FIG. 8H hereof, cramps, bands, as shown in FIG. 8I hereof, and chains to grip the surface and restrain the abrasive waterjet cutting head assembly.

Figure 9A:
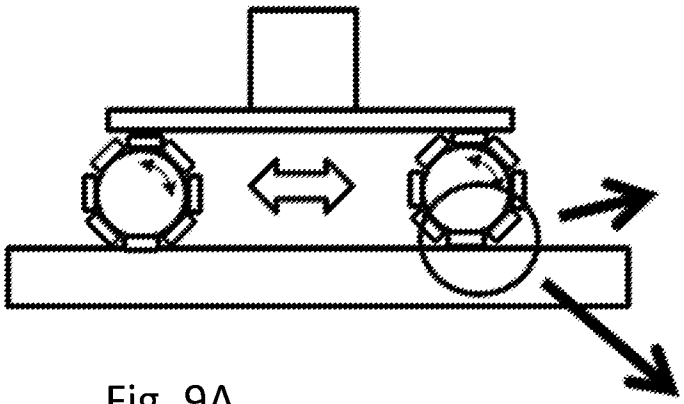
FIGS. 9A to 9F are simplified illustrations of additional preferred embodiments for attaching a moveable waterjet cutting head to the targeted object to be cut.
Figure 9B:
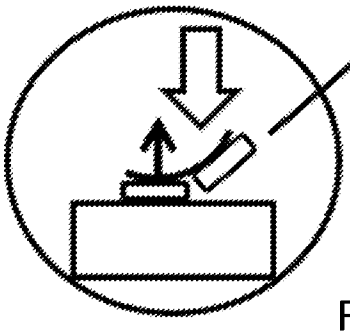
Figure 9C:
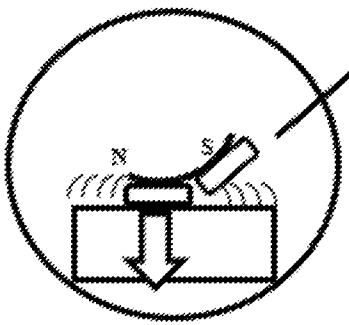
Figure 9E:
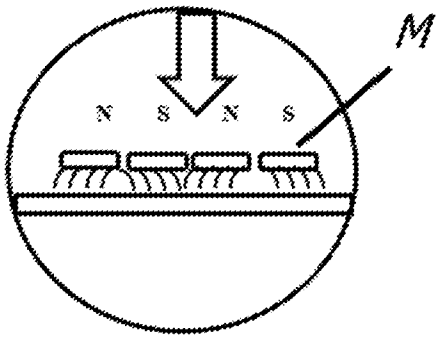
Figure 9F:
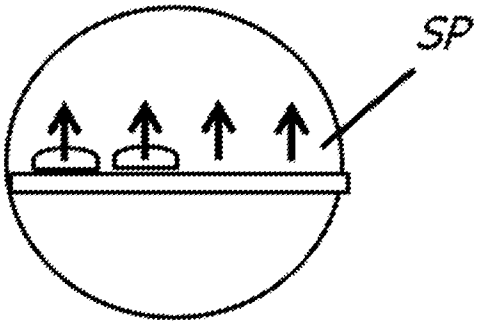
Figure 9D:
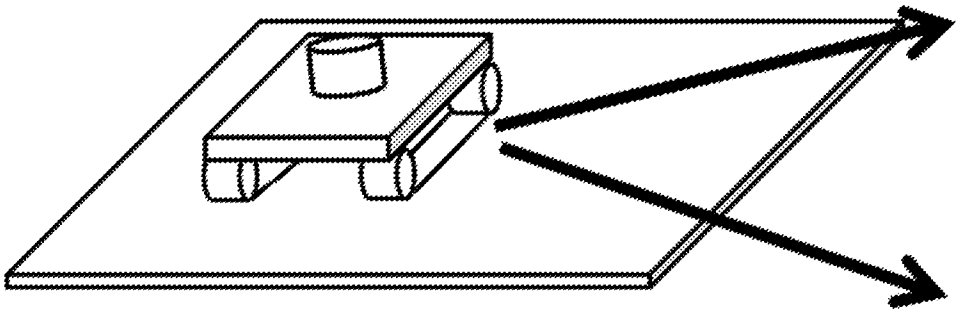

Another method for attaching the abrasive waterjet cutting head to the targeted object is to use movable fixtures that have their own means of attachment to the targeted object. For example, FIG. 9A hereof shows a wheeled fixture using a plurality of suction pads, as shown in FIG. 9B on the wheels, or using a plurality of permanent or electromagnets on the wheels, as shown in FIG. 9C. Still another method for attaching the movable fixtures to the targeted object is to use a movable track, shown in FIG. 9D, containing a plurality of permanent or electromagnets on the track, as in FIG. 9E, or suction pads as shown in FIG. 9F.

V. Controlling the Cutting of the Abrasive Waterjet Cutting Head.

Once the abrasive waterjet cutting head has been securely attached to the targeted object, a cutting control system, either autonomously or under the control of an operator, can energize the waterjet by allowing pressurized water to flow through the waterjet cutting head orifice to form the jet of water. The cutting control system will then verify that the jet of water has formed a sufficient vacuum in the abrasive mixing chamber measured, via a vacuum or pressure transducer, prior to energizing the abrasive feed and metering system using the abrasive control system. Once abrasive has been fed to the abrasive waterjet cutting head, the control system will continue to monitor the vacuum in the mixing chamber of the cutting head for abnormalities. The typical vacuum in an abrasive waterjet cutting head is approximately 27 to 29 inches of mercury.

Figure 10C:
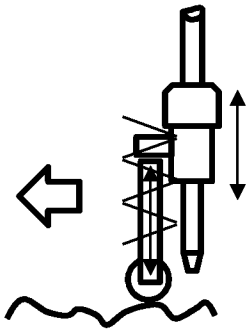
FIGS. 10A to 10I are simplified illustrations of preferred embodiments showing how the abrasive waterjet cutting head can be maintained at a predetermined "standoff" distance from the targeted object and controlling its' movement during the cutting operation.
Figure 10B:
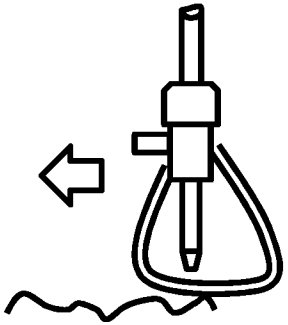
Figure 10A:
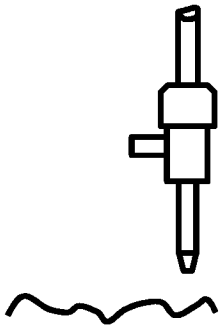

It is preferred that once attached to the targeted object, the abrasive waterjet cutting head is maintained at a predetermined standoff distance, FIG. 10A hereof, from the targeted object of approximately 0 to 13 mm, preferably from about 2 to 4 mm for optimal performance. Greater or lesser distances will affect the performance of the abrasive waterjet cutting process. This distance can be maintained by using either active or passive height adjustment systems.

Figure 10F:
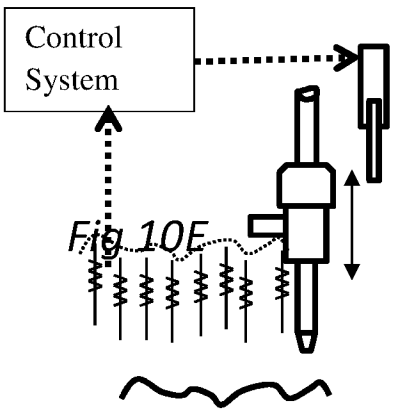
Figure 10E:
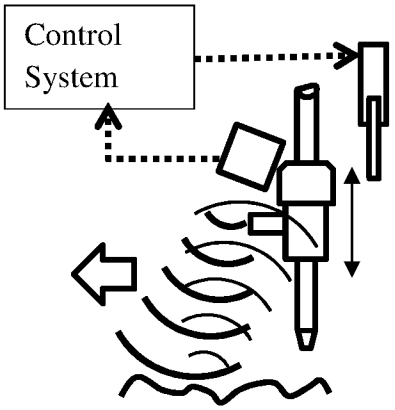
Figure 10D:
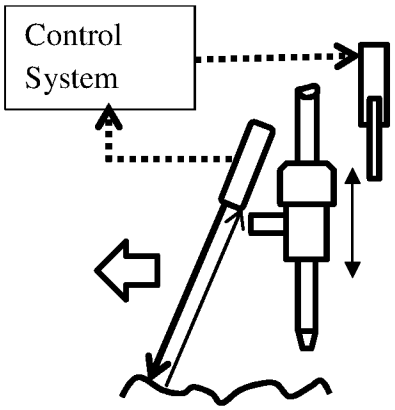

The simplest system for maintaining a functional standoff distance is to passively pre-align the abrasive waterjet cutting head to the desired height, plus some estimate for the target's topology, and operate it, as shown in FIG. 10B hereof, within a safe, but not necessarily optimal, operational envelope. A more accurate method is to utilize an active terrain following probe as shown in FIG. 10C hereof, such as a tracking wheel, that actively monitors the target's topology and moves the cutting head by mechanical, hydraulic, pneumatic, or electrical actuators to roughly optimize the standoff distance from the target. Another more accurate method is to use a computerized control system that adapts the height of the abrasive waterjet cutting head as it traverses the target by means of mechanical, hydraulic, pneumatic, or electrical actuators to maintain the optimal standoff distance as shown in FIGS. 10D through 10F hereof. The computer control system monitors the target surface information and the cutting head's speed and direction. The information is then stored in the computer memory forming a three-dimensional map of the target's terrain that is constantly updated as the cutting progresses. Control signals are then made to the mechanical, hydraulic, pneumatic, or electrical actuators to raise or lower the cutting head as needed in anticipation of changes in the target's topology.

Input to the cutting head standoff control system can be made by the use of a water penetrating laser range finder as shown in FIG. 10D hereof, preferably using a short wavelength light in the blue-violet spectrum, to provide accurate standoff distance prediction. As an alternative, high-frequency acoustic range finding can be used, preferably in the 200 kHz and above range, to accurately determine the standoff distance, as shown in FIG. 10*e* hereof, and to provide that information to the control system. Yet another alternative is to utilize one or more spring loaded pin(s), as shown in FIG. 10F hereof that provides a standoff depth gauge(s) that compress against the targeted object and generates a variable electrical signal, such as changing the resistance in the sensor by moving a potentiometer that can feed information back to the control system.

Figure 10H:
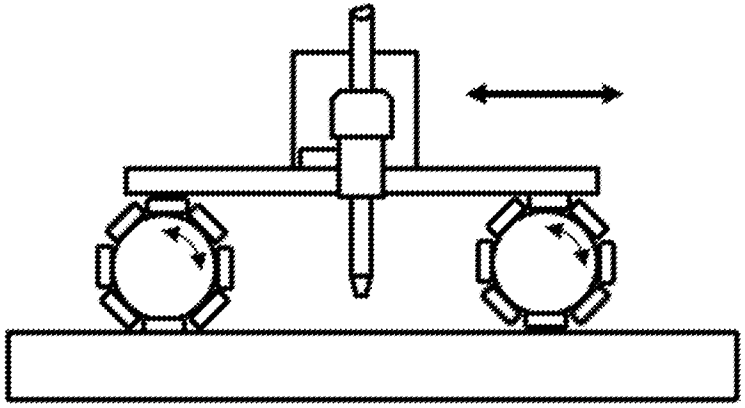
Figure 10I:
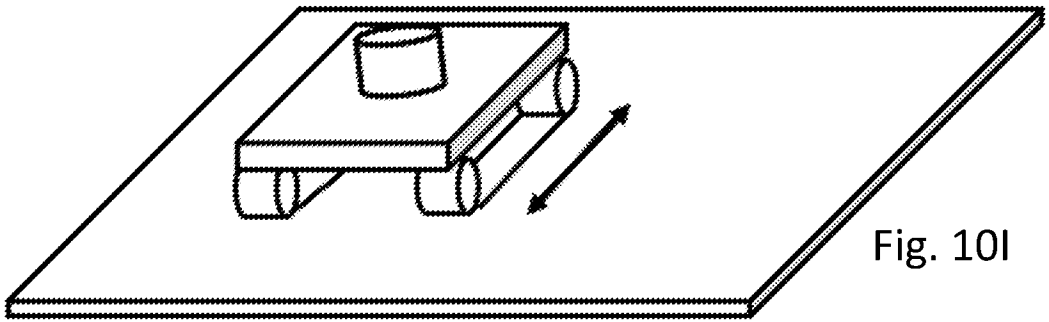
Figure 10G:
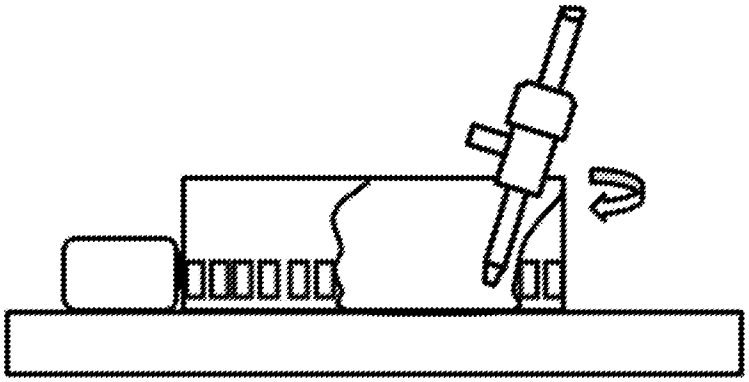

Once the correct standoff distance has been determined, the abrasive waterjet cutting head can be moved in a predetermined path for cutting the targeted object by using mechanical, hydraulic, pneumatic, or electrical motors to propel the mechanism by gear, chain, belt, cable, screw, or track, as shown in FIG. 10G-10I hereof. For example, an external gear can be engaged for driving the abrasive waterjet cutting head through a predetermined, preferably a circular, path to cut an opening as in FIG. 10G hereof. Likewise, the abrasive waterjet cutting head can be controlled using a one or more powered axes under the control of a computerized control system or controlled directly by an operator as shown in FIGS. 10H and 10I hereof. Although a linear cut, or a circular access hole, is expected to be the typical geometry of the abrasive waterjet cutting, a hole of any geometrical shape can be used.

VI—Waterjet Wash-Out of the Contents of the Targeted Object.

In certain cases, the cutting of the targeted object will be only one of several steps necessary to properly process the targeted object. In certain circumstances the targeted object may need to be drained and "washed out" to remove its contents for recovery or disposal. For example, the contents of a sunken ship may be valuable enough to be recovered, or the explosive contents of a DMM may be hazardous enough to warrant removal for safety, toxicity, or counter-terrorism reasons.

In order to properly washout the contents of the targeted object, the plug that was cut from the targeted object will have to be removed. There are several methods in accordance with the present invention that can be used to remove this plug. For example, in one method the attachment of the abrasive waterjet cutting head mechanism can be strategically placed in a sloped or inverted position so that gravity will help remove the plug from the access hole. This is illustrated in FIG. 11A hereof showing object OB, cutting head CH, attaching means AM, and contents CT of the interior of the object OB.

Figure 11B:
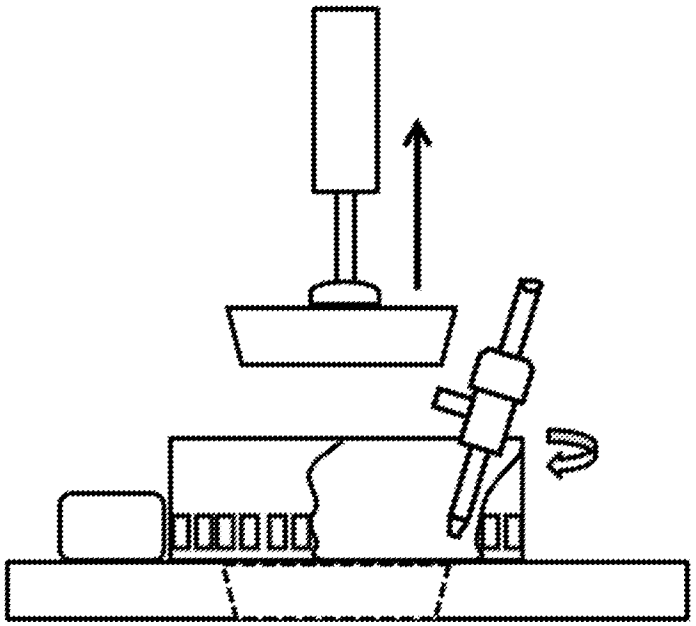
FIGS. 11A to 11E are simplified illustrations of preferred embodiments of removing a plug cut from the targeted object to access its' interior.
Figure 11A:
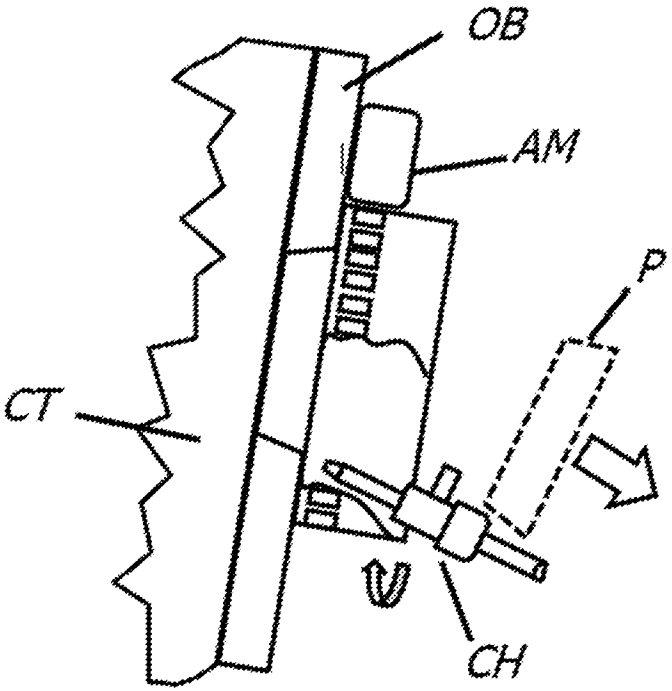
Figure 11E:
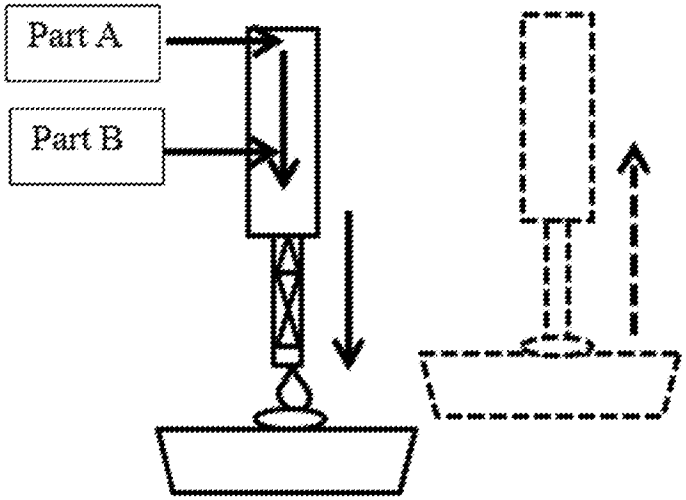
Figure 11D:
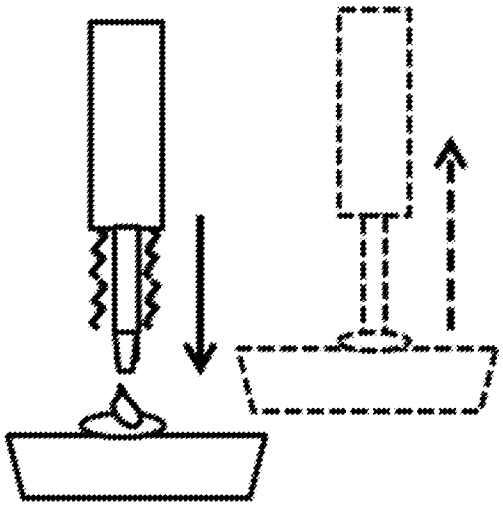
Figure 11C:
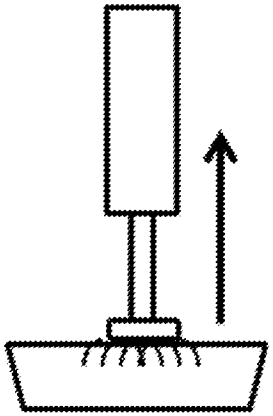

A suction pad, as illustrated in FIG. 11B can also be used having a manipulator to extract the cut plug. A third method is to use a magnetic attachment as illustrated in FIG. 11C hereof, either using a permanent magnet or an electromagnet, to attach to the plug, if it is ferromagnetic or paramagnetic. A fourth method is to apply an adhesive material to the plug as shown in FIG. 11D hereof so that an actuator can be used to remove and extract the cut plug. Non-limiting examples of suitable adhesives include those of a thermoplastic material, such as ethylene n-butyl acrylate (EnBA), ethylene-acrylic acid (EAA), and ethylene-ethyl acetate (EEA), adhesives. The heat for softening the thermoplastic material can be provided by any suitable conventional means, such as by electric resistance heating, hot fluid, such as hot hydraulic fluid, or by an exothermic reaction between two or more chemicals. Alternatively, the adhesive can be made from a one or more part polymer materials, as shown in FIG. 11E hereof, such as polyurethane or polymethylmethacrylate (PMMA), that is catalyzed with a suitable catalyst to form an effective bond.

Once the access hole has been formed and the plug is removed, the washout process can proceed. In some cases, the abrasive waterjet cutting head can be used to act as a washout jet by continuing to spray water, with or without abrasive, into the targeted object's interior. Although this process may not optimum, it is adequate for such materials as liquids and low melting point materials.

Figure 12B:
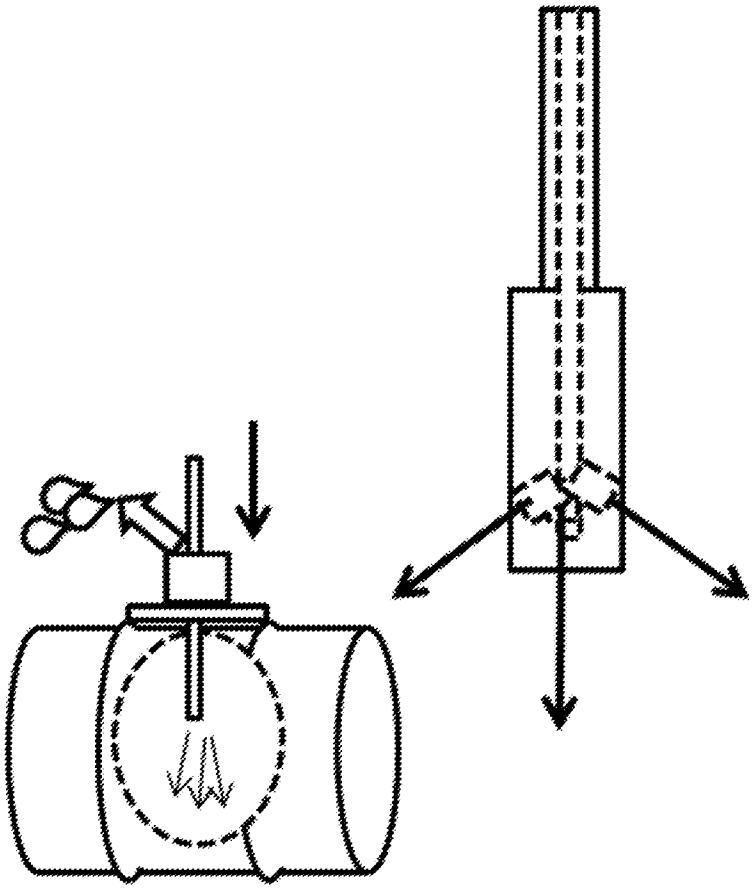
FIGS. 12A to 12D are simplified illustrations of preferred embodiments for washing out material found in the interior of a targeted object that was cut open.
Figure 12A:
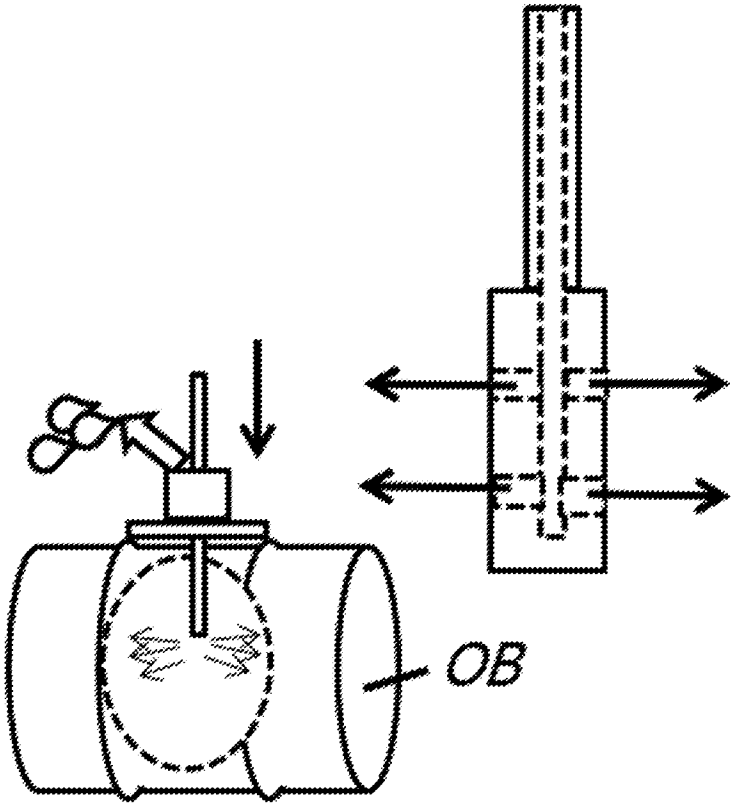

Another preferred method for removing materials from the targeted object's internal cavity is to introduce a secondary waterjet lance, wand, or tool that is specifically designed to direct water flow in the direction of the target object's internal mass. For example, the removal of residual materials within a submerged pipe will typically require one or more "side-firing" jet(s) in the nozzle body attached to the washout wand, as shown in FIG. 12A hereof, for an access hole made perpendicular to the long axis of the pipe. Alternatively, the nozzle body attached to the washout wand for an access hole made co-axially to the pipe may have a preponderance of "end-firing" jet(s), as shown in FIG. 12B hereof, to remove the mass of residual materials.

The waterjet washout lance, wand, or tool uses high pressure water, in the range of about 280 MPa to 1,000 MPa, preferably 380 MPa to 600 MPa, forced through one or more orifices to form high velocity droplets that act as kinetic impactors to erode and fragment the target object's internal mass. The fractured and fragmented internal mass is then flushed from the target's internal cavity by the waterjet and is ejected from the target. The water pressure used in the waterjet lance or wand can be varied so to optimize the fractured particle size of the solid material to be washed out and to minimize damage to the targeted object. A common engineering estimate is that the water pressure before the orifice should be at least three times the tensile yield strength of the material being washed out. For example, materials with tensile yield strength of about 100 MPa should require at least 300 MPa water in the waterjet before the orifice to be efficiently washed out with increasing pressures yielding smaller pieces. In some very small cases, the abrasive waterjet cutting head can act as a waterjet washout tool by shutting off the abrasive feed to the abrasive mixing chamber. The high velocity water jet, from the abrasive waterjet cutting head, will effectively washout small items, but for larger targeted objects a dedicated washout lance, wand, or tool should be used. The directionality of the waterjet lance, wand, or tool must be taken into account when determining which lance, wand, or tool should be used.

Figure 12C:
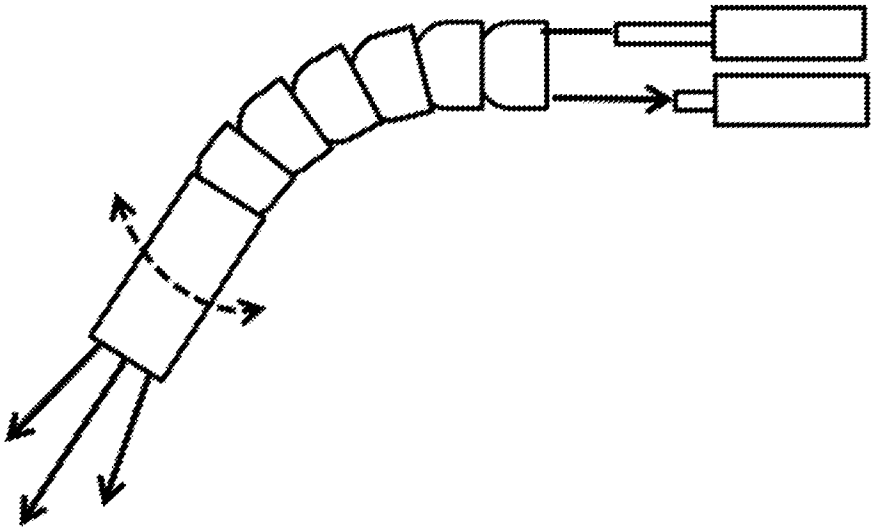
Figure 12D:
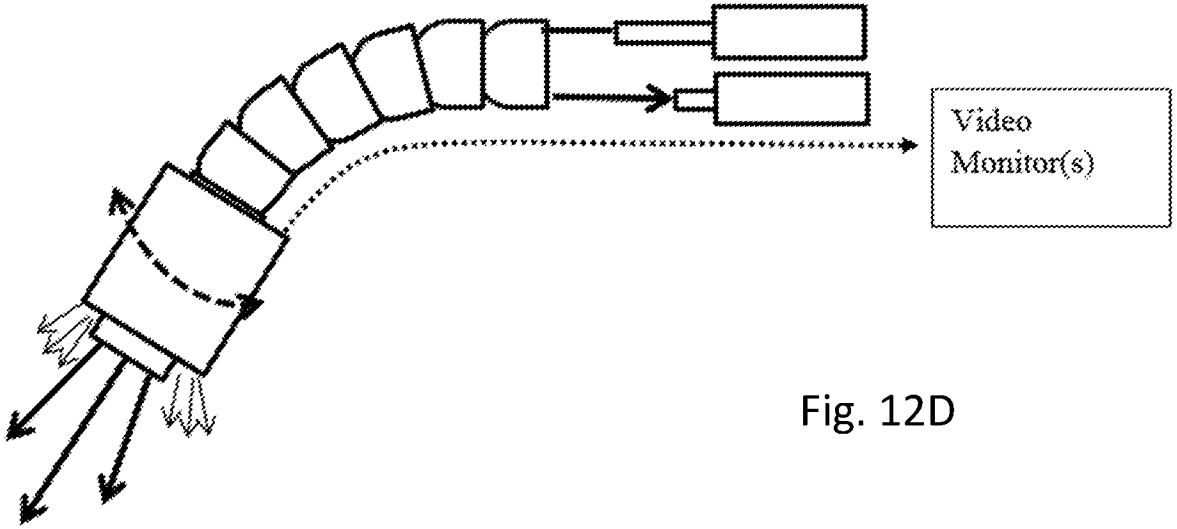

The waterjet lance can be positioned directly into the access hole, or it can be articulated so that the lance can be maneuvered to probe or extend into various internal areas of the targeted object. For example, the articulation can be performed by using multiple of nesting hollow cylinders, as shown in FIG. 12C hereof, with convex hemispheres on the distal end and concave hemispheres on the proximal end. The high pressure water for the washout operation is piped through the hollow portions of the cylinders. The washout wand is steered by retracing one or more of four steel cable(s), known as a tendon, to cause the distal end of the wand to bend in the direction desired. The articulation can be programmed under the control of a multi-axis computer controlled system or manually controlled by an operator using video feedback and teleoperated using a computer on the surface communicating with the submerged washout wand control system, as shown in FIGS. 12C and 12D hereof. The control system for the washout wand can be microprocessor controlled, using an Intel i7-2660K processor, etc.

The use of video cameras, also known as closed circuit television, or CCTV, can also be incorporated into the washout head to aid in visual inspection of the surfaces before or after washout. The video cameras are preferably fiber-optically fed images from a distal tip of the washout wand to a camera module located outside of the target housing in a waterproof housing. Illumination can be provided by light emitting diodes (LED) light sources, etc., illuminating the targeted objects' internal cavity or by fiber optic light pipes from external light sources, such as high power LEDs, providing light. The use of higher CCTV lighting can be more effective underwater because water rapidly attenuates the longer wavelength light.

The use of kinematic positioning sensors can be used to allow the computer control system to monitor the progress of the articulated washout wand and provide a visual display of the calculated position on a video monitor, or a human-machine interface (HMI) device. An example of a human-machine interface device is a microprocessor system using software to display video images and graphical icons of the equipment's operational state and feedback on the process parameters. This is generally part of a larger SCADA (supervisory control and data acquisition) process control system that is typically microprocessor based, using microprocessors such as the Intel i7-2660K, etc. The use of high pressure waterjets can provide the targeted objects' internal surface sufficiently clean enough to preclude further decontamination.

The object to be cut can be a munition containing energetic material that in many cases will have to be removed and collected. Non-limiting examples of type of energetic material that are typically found in munitions include ammonium perchlorate (AP); 2,4,6 trinitro-1,3-benzenediamine (DATB), ammonium picrate (Explosive D); cyclotetramethylene tetranitramine (HMX); nitrocellulose (NC); nitroguanidine (NQ); 2,2-bis[(nirtoxy)methyl]-1,3-propanediol dinitrate (PETN); hexahydro-1,3,5-trinitro-1,3,5-triazine (RDX); 2,4,5-trinitrophenol (TNP); hexahydro-1,3,5-benzenetriamine (TATB); N-methyl N-2.4.6-tetranitrobenzeneamine (Tetryl); 2-methyl-1,3,5-trinitrobenzene (TNT); Amatol (Ammonium Nitrate/TNT); Baratol ($Ba(NO_3)2$/TNT; black powder ($KNO_3$/S/C); Comp A (RDX/wax); Comp B (RDX/TNT); Comp C (RDX/plasticizer); Cyclotol (RDX/TNT); plastic bonded explosives (PBX); LOVA propellant; NACO propellant; any combination of the above materials; rocket propellant; Octol (HMX/TNT), hexanitrodiphenylamine (HND) and trinitroanisol.

A munition will typically contain one or more fuzes. If more than one fuze one will be typically be located at the front of the munition and the other at the back. It is preferred that one or both of the fuzes be removed to form an access point to washout the energetic material. Once the one or more fuzes have been removed the munition, depending on its structural integrity can be brought to the surface to have the energetic material washed out or it can be washed out underwater and collected to be brought to the surface for further disposal or processing.

VII Collecting the Washed-Out Contents of the Targeted Object.

Some materials washed out from the targeted object may be valuable and may need to be captured for recovery, or may be harmful and need to be captured for later disposal. Typical concerns for materials that are harmful are those that may be toxic, corrosive, radioactive, or explosive.

In the event the interior material of the targeted object is to be captured and sequestered for later recovery or disposal, the abrasive waterjet cutting head can be attached by use of an obturating seal, or ring, to prevent leakage into the environment. An obturating ring is a ring of relatively soft material designed to obturate under pressure to form a seal. Obturating rings are often found in artillery and other ballistics applications and similar devices are also used in other applications such as plumbing wherein they are often called O-rings. The obturating seal is preferably made of a compliant polymer material capable of being adequately deformed so that any marine growth or irregularity on the surface of the targeted object can be readily accommodated. A preferred seal material is a 20 shore A durometer neoprene rubber that is capable of making a serviceable obturating seal using between 100 and 500 N (22.5 to 112 lbf) of pressure.

The abrasive waterjet mechanism can also have a containment housing that will allow materials ejected by the washout process to flow through an outlet into a collection device. A check valve can be used at the inlet of a collection device to prevent escape of the collected materials into the environment. The collection device can be constructed in several non-limiting ways. For example, a polymer bag, with or without fibrous reinforcement, can be used to capture and sequester effluent liquids and solids. The polymer bag is preferably selected to minimize adverse interaction between the known or suspected contents of the targeted object. It is preferably constructed of layers of different polymers specifically chosen for their attributes, such as inertness to chemicals, tear resistance, strength, cost, etc. Non-limiting examples of such polymers that can be used in the practice of the present invention include: DuPont Tedlar polyvinyl fluoride (PVF) and Viton fluoroelastomer films that provide excellent chemical resistance and strength for such applications. For additional strength, an exterior bag of reinforced polymer, such as used in ATL Subsea Flexible Fluid Containment Bladders can be used. The polymer collection bags for the effluent collection device are preferably about 50 micron (2 mil) to about 6.35 mm (250 mil) thick. Similar polymer bags are used by the U.S. military for storing fuels above surface and are known as fuel bladders.

The removal of materials from the targeted object to the collection device can be accomplished by passively using the water from the waterjet to displace the targeted object's contents or to actively use a pump or eductor to remove the contents of the targeted object into the collection device.

If a pump is used, it can be of any suitable type to remove the water used in the washout process and the contents of the targeted object. For example, an eductor style pump can be used employing a constant flow of water, either from the underwater environment or on a recycle loop from the effluent collection device. Also, a pneumatically or hydraulically driven diaphragm pump having one or more chambers, can be used, as well as a progressive cavity pump can be used to pump out the contents of the target item and transfer them into the collection device. Other non-limiting examples of suitable pumps include: a laminar flow disk pump: a lobe pump: a centrifugal pump; a piston pump; and a peristaltic hose pump.

Collection devices can also be made from any suitable material, non-limiting examples which include: plastic, metallic, or composite materials forming rigid or semi-rigid tanks. A non-limiting example is a 200 liter Faber Fibre Steel Composite Cylinder. Such tanks can be sufficiently rigid to allow being submerged in an evacuated state and allowing the contents of the targeted object to be aspirated without the use of a pump. The collection device can be fitted with a moveable diaphragm or membrane that will allow the pumping out of water from one side to form a partial vacuum on the other, allowing effluent to be evacuated from the targeted object without the use of an effluent transfer pump as described above.

These collection device can also be flooded with water and the water utilized as a flush or rinse water to clean the interior of the target item. The removed ballast water can also be used as the motive fluid in an eductor to move the effluent stream from the targeted object. Once inside of the collection device, the washed-out materials can be further stabilized by absorption into a porous material or by using a super absorbent material, etc., to form a gelatinous mass that is resistant to leakage into the environment.

Flotation and ballast control of the effluent collection device can be controlled in positively buoyant devices by the use of removable or disposal ballast in the form of solid materials that are sufficiently denser than water. For example, steel shot having a density of about 2 gm/cm$^3$ to about 20 gm/cm$^3$, preferably about 8 gm/cm$^3$, can be jettisoned from the effluent collection device by being released by an electromagnet by removing the electrical energy supply. The density of magnetic shot can be adjusted using low density filler, such as glass microspheres, or adding high density materials, such as tungsten, to the magnetic material. In negatively or neutrally buoyant devices, the introduction of compressed gas, lower density fluids, or rigid void spaces into the device, or into a compartment on the exterior of the collection device, can be used to adjust the buoyancy of the device. Rigid void spaces can include materials such as glass spheres capable of withstanding the ambient hydrostatic pressure. Preferred are glass microspheres. These glass microspheres can be used loose or bound in a matrix of epoxy, etc., in a material known as syntactic foam. Non-limiting examples of lower density liquids that can be used in seawater include freshwater, mineral oils, and vegetable oils, preferably canola oil.

The recovered effluent, once captured in the collection device, can be processed for recovering water from the liquid portion. For example, in the washout of trinitrotoluene (TNT) from DMM, the washout water will not appreciably dissolve the TNT. The solubility of TNT in water is only approximately 100 mg/liter at ocean temperatures. The TNT will remain as a solid fraction while the washout water will separate into a liquid phase. This liquid phase water can be reused in the washout process even with a small fraction of TNT dissolved in it. Using TNT saturated feed water in the high pressure waterjet intensifier only slightly increases the wear on the check valves and is acceptable. Non-limiting methods for separating solid fractions from liquid fractions include centrifuges and mechanical filters. Not all materials will lend themselves to being readily separated into product and reusable water. However, for those materials that are minimally water soluble, the recovery of process water for reuse in the waterjet or eductor will provide a reduction in stored process water required as well as reducing the amount of waste material that needs to be disposed of. The disposal of waste water and effluents can be performed by returning the effluents to the surface and disposed of using established disposal methods already approved by the environmental protection agency.

What is claimed is:

1. Underwater abrasive entrainment waterjet cutting apparatus comprised of:

a) a remotely operated vehicle located below the surface of a body of water, which remotely operated vehicle comprises a hydraulic system and at least one prime mover system;

b) an entrainment abrasive waterjet cutting head comprising a mixing chamber, a process water inlet to said mixing chamber, and an inlet for particulate abrasive material, which waterjet cutting head is within reach of said remotely operated vehicle;

c) a source of particulate abrasive material in fluid communication with said mixing chamber;

d) a means capable of feeding said particulate abrasive cutting material to said cutting head in a controlled manner;

e) a waterjet pump being within reach of said remotely operated vehicle and in fluid communication with a source of process water, which waterjet pump is capable of delivering a jet of water at a pressure of at least 280 MPa to said waterjet cutting head, wherein said waterjet pump is driven by either the hydraulic system or the prime mover of said remotely operated vehicle.

2. The apparatus of claim 1 wherein said waterjet pump is an intensifier pump and is driven by the hydraulic system of said remotely operated vehicle.

3. The apparatus of claim 2 wherein the hydraulic power used to power said intensifier waterjet pump is supplied via a hot-stab plug of said remotely operated vehicle having a hydraulic receptacle for a hot-stab plug.

4. The apparatus of claim 1 wherein said waterjet pump is a reciprocating pump that shares a prime mover with said remotely operated vehicle.

5. The apparatus of claim 1 wherein the apparatus also includes an abrasive metering system capable of metering abrasive to said waterjet cutting head.

* * * * *